US010780487B2

(12) United States Patent
Tang et al.

(10) Patent No.: US 10,780,487 B2
(45) Date of Patent: Sep. 22, 2020

(54) BENDING AND MOLDING PRODUCTION LINE

(71) Applicants: JIANGSU UNIVERSITY OF SCIENCE AND TECHNOLOGY INDUSTRIAL TECHNOLOGY RESEARCH INSTITUTE OF ZHANGJIAGANG, Zhangjiagang, Jiangsu (CN); JIANGSU UNIVERSITY OF SCIENCE AND TECHNOLOGY, Zhenjiang, Jiangsu (CN)

(72) Inventors: Wenxian Tang, Jiangsu (CN); Jian Zhang, Jiangsu (CN); Hongcai Lin, Jiangsu (CN); Yang Zhang, Jiangsu (CN); Qinfeng Li, Jiangsu (CN); Zhigao Tao, Jiangsu (CN); Xia Li, Jiangsu (CN); Shuyan Wang, Jiangsu (CN)

(73) Assignees: JIANGSU UNIVERSITY OF SCIENCE AND TECHNOLOGY INDUSTRIAL TECHNOLOGY RESEARCH INSTITUTE OF ZHANGJIAGANG, Zhangjiagang (CN); JIANGSU UNIVERSITY OF SCIENCE AND TECHNOLOGY, Zhenjiang (CN)

( * ) Notice: Subject to any disclaimer, the term of this patent is extended or adjusted under 35 U.S.C. 154(b) by 0 days.

(21) Appl. No.: 15/535,685

(22) PCT Filed: Feb. 22, 2016

(86) PCT No.: PCT/CN2016/074209

§ 371 (c)(1),
(2) Date: Jun. 13, 2017

(87) PCT Pub. No.: WO2016/165479

PCT Pub. Date: Oct. 20, 2016

(65) Prior Publication Data

US 2018/0021838 A1 Jan. 25, 2018

(30) Foreign Application Priority Data

Apr. 13, 2015 (CN) ..... 2015 1 0170509

(51) Int. Cl.
*B21D 35/00* (2006.01)
*B21F 1/00* (2006.01)
(Continued)

(52) U.S. Cl.
CPC ..... *B21D 35/002* (2013.01); *B21D 7/024* (2013.01); *B21D 7/08* (2013.01); *B21D 7/16* (2013.01);
(Continued)

(58) Field of Classification Search
CPC ... B21D 7/00; B21D 7/02; B21D 7/04; B21D 7/08; B21D 7/022; B21D 7/0225;
(Continued)

(56) References Cited

U.S. PATENT DOCUMENTS 3,053,307 A * 9/1962 Hunter ..... B21D 3/08 72/79
4,724,733 A * 2/1988 Suarez ..... B23D 21/00 72/129
(Continued)

FOREIGN PATENT DOCUMENTS

CN 101474651 A 7/2009
CN 101791662 A 8/2010
(Continued)

OTHER PUBLICATIONS https://www.youtube.com/watch?v=tfreT6JFjNE (OMCG Turbobender CNC wire bending machine video. Published Sep. 2013. Video is 1:37 long. (Year: 2013).*
(Continued)

*Primary Examiner* — Adam J Eiseman
*Assistant Examiner* — Matthew Kresse
(74) *Attorney, Agent, or Firm* — Oliff PLC

(57) ABSTRACT

A bending and molding production line includes an unwinding mechanism, a feeding and straightening device, a cutting-off mechanism, a bending and molding device and a material loading mechanism, wherein the bending and molding device includes a base, the base is provided with two
(Continued)

transverse sliding bases, the base is provided with a transverse driving device driving the transverse sliding bases, the base is provided with a central clamping device between the two transverse sliding bases, the transverse sliding bases are provided with a longitudinal sliding base in a sliding manner and are provided with a longitudinal driving device driving the longitudinal sliding base to slide, the longitudinal sliding base is provided with a bending and molding device, the transverse sliding base at the left side is provided with a left clamping device, and the transverse sliding base at the right side is provided with a right clamping device.

13 Claims, 15 Drawing Sheets

(51) Int. Cl.
*B21D 7/024* (2006.01)
*B21D 7/16* (2006.01)
*B21D 7/08* (2006.01)
*B21F 1/02* (2006.01)

(52) U.S. Cl.
CPC ..... *B21D 35/00* (2013.01); *B21F 1/00* (2013.01); *B21F 1/026* (2013.01)

(58) Field of Classification Search
CPC ..... B21D 7/024; B21D 7/025; B21D 7/028; B21D 7/12; B21D 7/14; B21D 7/16; B21D 11/00; B21D 11/22; B21D 37/04; B21D 37/14; B21F 1/00; B21F 1/006; B21F 1/008; B21F 1/02; B21F 1/023; B21F 1/026; B25J 9/04
See application file for complete search history.

(56) References Cited

U.S. PATENT DOCUMENTS

| | | | | |
|---|---|---|---|---|
| 7,721,582 | B2 * | 5/2010 | Speck | B21D 11/00 72/306 |
| 2006/0207677 | A1 | 9/2006 | Carr | |
| 2013/0270385 | A1 * | 10/2013 | Wolf | B21C 47/16 242/566 |

FOREIGN PATENT DOCUMENTS

| | | | |
|---|---|---|---|
| CN | 201618768 | U | 11/2010 |
| CN | 202021247 | U | 11/2011 |
| CN | 102430661 | A | 5/2012 |
| CN | 203281764 | U | 11/2013 |
| CN | 103785726 | A | 5/2014 |
| CN | 203751683 | U | 8/2014 |
| CN | 203791534 | U | 8/2014 |
| CN | 104826925 | A | 8/2015 |
| CN | 204523981 | U | 8/2015 |
| EP | 1 700 647 | A | 9/2006 |
| JP | H 10225742 | A | 8/1998 |
| JP | 2011-079028 | A | 4/2011 |
| TW | 201402244 | A | 1/2014 |

OTHER PUBLICATIONS https://www.youtube.com/watch?time_continue=45&v=eYwNycT-tgps (Numalliance R21XX. Published Aug. 2013. Video is 0:57s long. (Year: 2013).*

* cited by examiner

BENDING AND MOLDING PRODUCTION LINE

CROSS-REFERENCE TO RELATED APPLICATIONS

This is a National Stage Entry of PCT/CN2016/074209, filed Feb. 22, 2016, which claims priority to Chinese Application No. 201510170509.5, filed Apr. 13, 2015. The disclosures of the prior applications are hereby incorporated by reference herein in their entireties.

BACKGROUND

Technical Field

The present invention relates to a bending and molding production line.

Related Art

For the bending and molding production line of a tubular product such as an air conditioner tube and an engine oil tube, a tubular product coil material is required to be straightened into a material with certain straightness, and is then bent and molded. At present, such bent tubular product is widely applied to the field of engines, in particular an oil path in an aerospace airspace engine, a ship engine and a vehicle engine. But since the bending precision of the tubular product is low or a residual stress is overlarge, a workpiece is failed, which leads to a loss of social properties.

A complete tubular product automatic bending production line comprises an unwinding mechanism, a feeding and straightening device, a cutting-off mechanism, a bending and molding device and a material loading mechanism for transferring the tubular product to the bending and molding device from the cutting-off mechanism. However, the existing such type of devices difficultly constitute an automatic bending production line with a high precision and a high production efficiency. The causes are as follows:

Firstly, a traditional single-head bending device is lower in efficiency due to a lower bending speed. At present, some dual-head bending devices are emerged on the market, but most of the existing dual-head bending mechanisms can realize symmetric bending instead of asymmetric machining, and the machining efficiency is low; meanwhile, the maintenance of a power part is large in mounting and dismounting work amount, efficient replacement and maintenance are hard to realize, and a low working efficiency is caused. For example, the patent with a patent number 201020147236.5 discloses a tube bending machine, a bending device thereof can realize symmetric bending only and cannot provide the machining of asymmetric tubes and tubular products. For example, the patent with a patent number 201020595165.5, discloses a tube bending machine, a power part of a bending device thereof is relatively complex to mount and dismount, and efficient maintenance is hard to realize, which leads to a low working efficiency.

In addition, the bending and molding device is required to be provided with a clamping mechanism which clamps and rotates the tubular product to realize the space bending of the tubular product. But the existing clamping device is relatively complex in structure and difficult to machine and mount, a power transmission system is instable, a rotation precision is lower, causing that a finished product of the tubular product does not meet the requirements. For example, the Chinese Patent with a patent number CN 203281764 U discloses an automatic bending machine, such bending machine adopts a rotation clamping mechanism capable of rotating around the axis of a metal tubular product by 360 degrees, but a shearing mechanism and a bending mechanism of the device are also located on the rotation mechanism, causing that the whole device is very complex in structure and is unfavorable for mounting, and the device is larger in power demand and higher in manufacture cost.

For a conventional storing and feeding device for a coiled tubular product, in a use process, when a discharging speed of the tubular product is larger than or smaller than a receiving speed of a machining device, the tubular product has a phenomenon of bending and extruding or a gradually increased tension, cannot be automatically restored, and can work only after an artificial solution, and not only is the production efficiency reduced, but also a manual cost is increased.

SUMMARY

The present invention aims to solve the technical problem about providing a bending and molding production line, which can bend two sides of a tubular product or wire stock at different bending angles and different bending radii and has a high working efficiency.

In order to solve the above problem, the technical solution adopted by the present invention is: a bending and molding production line, comprising an unwinding mechanism, a feeding and straightening device, a cutting-off mechanism, a bending and molding device and a material loading mechanism for transferring the tubular product to the bending and molding device from the cutting-off mechanism, wherein the bending and molding device comprises a base, the base is provided with a transverse sliding rail, two transverse sliding bases are disposed on the transverse sliding rail in a sliding manner, the base is provided with a transverse driving device driving the transverse sliding bases, the base is provided with a central clamping device which can clamp the tubular product and can rotate around a central axis of the tubular product between the two transverse sliding bases, the transverse sliding bases are provided with a longitudinal sliding rail, the longitudinal sliding rail is provided with a longitudinal sliding base, the transverse sliding bases are provided with a longitudinal driving device driving the longitudinal sliding base to slide, the longitudinal sliding base is provided with a bending and molding device, one side, close to the central clamping device, of the transverse sliding base at the left side is provided with a left clamping device capable of movably extending to clamp the tubular product, one side, close to the central clamping device, of the transverse sliding base at the right side is provided with a right clamping device capable of movably extending to clamp the tubular product, the bending and molding mechanism comprises a hollow mounting base rotatably disposed on the longitudinal sliding base, a hollow shaft is rotatably disposed in the mounting base in a penetrating manner, a mandrel is rotatably disposed in the hollow shaft in a penetrating manner, a longitudinal sliding base extends out of one ends of the hollow shaft and the mandrel, the hollow shaft is provided with a moving bending head at this end, the end part of the moving bending head is cylindrical and its periphery is provided with a circle of groove matched with the tubular product to be matched, the mandrel is detachably provided with a fixed bending die at this end, the fixed bending die is provided with four cylindrical fixed bending modules of which the connecting lines are in a rectangle, an interval between two rows of fixed bending modules is matched with a diameter of the tubular product to be bent, the other end of the mandrel is connected to a fixed die motor disposed on the longitudinal sliding base, a driven synchronous bent wheel sleeves the periphery of the other end of the hollow shaft, the longitudinal sliding base is provided with a moving die motor, an output shaft of the moving die motor is provided with a driving synchronous belt wheel matched with the driven synchronous belt wheel, and a synchronous belt sleeves the driven synchronous belt wheel and the driving synchronous belt wheel.

The left clamping device comprises a left base disposed on the longitudinal sliding base at the left side, a certain included angle exists between the upper surface of the longitudinal sliding base and the left base, the upper surface of the left base is provided with a left sliding rail, the left sliding rail is provided with a left sliding base, the left sliding base is provided with a left mounting base, the left mounting base is provided with a clamping component driven by a clamping cylinder to open or clamp, and the left base is provided with a sliding cylinder driving the left sliding base to drive the clamping component to approach to the tubular product from bottom to top; the right clamping device comprises a right base disposed on the longitudinal sliding base at the right side, a certain included angle exists between the upper surface of the longitudinal sliding base and the right base, the right base is provided with a right sliding rail, the right sliding rail is provided with a right sliding base, the right sliding base is provided with a right mounting base, the right mounting base is provided with a clamping component driven by a clamping cylinder to open or clamp, and the right base is provided with a sliding cylinder driving the right sliding base to drive the clamping component to approach to the tubular product from top to bottom; and the bending and molding mechanism is disposed in the position of the longitudinal sliding base close to the central clamping device as much as possible.

The present invention aims to solve the technical problem about providing a bending and molding production line with a high precision.

In order to solve the technical problem, the technical solution adopted by the present invention is: the central clamping device comprises a box body, a rotary gear disk rotatably disposed on the box body, a power device disposed on the box body, a transmission mechanism connected to the rotary gear disk and the power device, and a clamping mechanism disposed on the rotary gear disk for clamping the tubular product, wherein the rotary gear disk is provided with a containing notch penetrating through the center of the rotary gear disk; the clamping mechanism comprises a left clamping block and a right clamping block; the left clamping block and the right clamping block are symmetric and the bottom ends are hinged to a disk surface of the rotary gear disk; the upper parts at opposite sides of the left clamping block and the right clamping block are provided with a left chuck and a right chuck respectively; the axis of the tubular product clamped by the left chuck and the right chuck is coincided with a central axis of the rotary gear disk; the lower part of the left clamping block located on the left chuck is provided with a left pushing block, the lower part of the right clamping block located on the right chuck is provided with a right pushing block, the upper parts of one sides, back onto each other, of the left clamping block and the right clamping block are connected to the rotary gear disk by a left tension spring and a right tension spring respectively, and a pull force of the left tension spring and the right tension spring drives the left chuck and the right chuck to abut against each other; the lower part of the disk surface of the rotary gear disk located on the left pushing block and the right pushing block is provided with a reset pushing rod, the box body is provided with a reset oil cylinder driving the reset pushing rod to move, the reset pushing rod pushes the left pushing block and the right pushing block when pushes upward, such that the left clamping block and the right clamping block rotate to separate the left chuck from the right chuck; the transmission mechanism comprises a left transition gear and a right transition gear disposed on two sides of the reset oil cylinder in the box body respectively and meshed with the rotary gear disk, a left transmission gear meshed with the left transition gear and a right transmission gear meshed with the right transition gear are disposed in the box body, a left synchronous belt coaxial and capable of synchronous rotating with the left transmission gear and a right synchronous belt coaxial and capable of synchronous rotating with the right transmission gear are further disposed in the box body, the output shaft of the power device is fixedly connected to a main synchronous belt wheel, and a synchronous belt sleeves the main synchronous belt wheel, the left synchronous belt wheel and the right synchronous belt wheel.

The present invention solves the technical problem about providing a bending and molding production ling with a high degree of automation.

In order to solve the technical problem, the technical solution adopted by the present invention is: the box body is further provided with a poking mechanism for unloading, the poking mechanism comprises a main poking shaft vertical to the rotary gear disk and rotatably connected to the box body, two ends of the main poking shaft extend out of the box body and are connected to a poking arm which pokes the tubular product out of the containing notch respectively when rotating, a main poking gear is fixedly disposed on the main poking shaft in the box body, a slave poking gear meshed with the main poking gear is rotatably disposed in the box body, a poking gear shaft is rotatably disposed in the box body, a third poking gear meshed with the slave poking gear is fixedly disposed on the poking gear shaft, a poking cylinder is disposed under the third poking gear in the box body, a rack is disposed at the end part of a piston rod of the poking cylinder, the rack is meshed with a poking driving gear fixedly sleeving the poking gear shaft, and the upper part of the reset oil cylinder in the box body is further provided with a poking oil cylinder capable of driving the reset pushing rod to move.

As a preferable solution, the longitudinal driving device comprises a longitudinal servomotor disposed on the transverse sliding base, the longitudinal sliding base is provided with a longitudinal lead screw, and the longitudinal servomotor is connected to the end part of the longitudinal lead screw by a coupler.

As a preferable solution, the transverse driving device comprises a rack disposed on the base, the transverse sliding base is provided with a transverse driving motor, and an output shaft of the transverse driving motor downwards penetrates out of the transverse sliding base and is connected to a synchronous belt wheel matched with the rack.

As a preferable solution, the unwinding mechanism comprises a box type base, a motor and a speed reducer connected to the motor are disposed in the base, a material disc is rotatably disposed on the base, the speed reducer drives the material disc to rotate, the material disc is provided with a central rod coaxial with an output shaft of the speed reducer, the material disc is provided with at least three blocking rods, the blocking rods are uniformly distributed around the central rod, the base is also fixedly connected to a bottom plate, the bottom plate is rotatably provided with a revolution bottom plate, the bottom plate and the revolution bottom plate are rotatably connected by a rotary shaft, the rotary shaft is parallel with the central rod, a reset spring is further disposed between the bottom plate and the revolution bottom plate, one end of the reset spring is fixedly connected on the bottom plate, the other end of the reset spring is fixedly connected to the revolution bottom plate, the upper surface of the revolution bottom plate is connected to a treading rod guiding a moving trend of the tubular product, the treading rod and the central rod are matched, the top end of the treading rod is provided with a limiting device preventing the tubular product from being separated from the treading rod, the revolution bottom plate is further provided with an angle measuring sensor for measuring a swing angle of the treading rod, the base is provided with a controller electrically connected to the angle measurement sensor, and the controller is used for controlling operation of the motor.

As a preferable solution, the feeding straightening device comprises a rack, the rack is provided with two pairs of feeding wheels, a straightening mechanism and a length fixing mechanism along a straight line in sequence, a wire passing base is disposed at the front part of the feeding wheels, between the two pairs of the feeding wheels and between the feeding wheels and the straightening mechanism on the rack respectively, the straightening mechanism comprises a hollow shaft-like straightening component rotatably disposed on the rack and a straightening power system driving the hollow shaft-like straightening component to rotate, the hollow shaft-like straightening component comprises a hollow left end shaft, at least three straightening dies and a hollow right end shaft, the left end shaft and the right end shaft are rotatably disposed on the rack respectively, a connecting block with a material passing hole in the middle is disposed among the adjacent straightening dies, the positions of the straightening dies meet a condition that the central lines of all straightening dies are in staggered arrangement relative to the axis of the left end shaft, the straightening die comprises two straightening modules provided with semicircular slots matched with the diameter of the tubular product to be straightened, connecting surfaces of the left end shaft, the connecting blocks and the right end shaft matched with the straightening dies are provided a mounting groove matched with the shape of the straightening die and an arc slot located for compressing compression bolts of the straightening dies and internally provided with a plurality of threaded sections respectively, the length fixing mechanism comprises a pair of measuring wheels driven by the tubular product to rotate and placed on the rack, and one of the measuring wheels is connected to a revolution encoder.

As a preferably solution, the cutting-off mechanism comprises a mounting base, the mounting base is provided with two upright plates vertical to each other, one upright plate is provided with a fixed shearing head, the other upright plate parallel with a feeding direction is provided with a shearing oil cylinder and the end part of the piston rod of the shearing oil cylinder is provided with a moving shearing head matched with the fixed shearing head.

As a preferable solution, the material loading mechanism comprises two end part mounting frames disposed on two ends of the base of the bending and molding device respectively, the end part mounting frames are rotatably provided with a transmission shaft and a charging power device driving the transmission shaft, the transmission shaft is provided with at least two material holding arms in parallel, the end part of each material holding arm is provided with a pneumatic clamping component which is controlled by a cylinder to open or clamp, and the positions of the material holding arms are matched with the positions where the cutting-off mechanism and the central camping mechanism charge the tubular product.

The present invention has the beneficial effects: since in the bending and molding device, the central clamping device is adopted to clamp the tubular product, and a dual-head single bending manner is adopted, the two ends can meet the requirements of different bending angles, bending radii and bending lengths, the asymmetric bending of the tubular product can be realized, the working flexibility of the bending machine is improved, and the working efficiency is greatly improved.

Since the clamping device is adopted beside the bending and molding device and plays a role of locating the tubular product, the tubular product in the position close to the bending and molding device is prevented from generating unnecessary bending deformation, such that the product quality is ensured.

Since the clamping component of the clamping device is driven by the cylinder, such that in the bending process, the tubular product is stably bent, the vibration generated during bending is reduced, and the working reliability of the whole device is improved.

Since the hollow shaft is provided with the moving bending head, the mandrel is detachably provided with the fixed bending die, and the central shaft and the mandrel are respectively driven by an external power connecting device, the whole structure is simple and convenient to mount.

Since the transmission mechanism of the central clamping device comprises the left transition gear and the right transition gear which are disposed at two sides of the reset oil cylinder in the box body and meshed with the rotary gear disk respectively, due to a driving manner of the two transition gears, the rotation of the rotation gear disk is more stable, a rotation error possibly caused by a gear side gap in a forward and backward rotation process due to the driving from single side gears is avoided, such that the device is higher in rotation precision, error accumulation is avoided, and therefore, the bending quality of the tubular product is improved; and the driving of the synchronous belt and the synchronous belt wheel is adopted, such that the advantages of buffering and damping, stable transmission and convenience in maintenance are realized.

The clamping mechanism adopts a spring self-clamping structure, and is simple in structure and stable in clamping force, the oil cylinders are only disposed in the charging position and poking position, the clamping mechanism can be only opened by push of the piston rod, the separation between the power and structure is realized, and the stability of the clamping mechanism in a rotation process of the rotary gear disk is ensured.

Since the central clamping device is provided with the poking mechanism, the effects of automatic unloading, improved degree of automation and reduced labor cost are realized.

Since the unwinding device adopts the angle measuring sensor disposed on the swingable treading rod, when the tension of the tubular product in conveying is increased to draw the treading rod to swing by a certain angle, the angle measuring sensor can send a signal to the controller, and the controller can control the motor to start to release a coil on the material disc, such that the tension of the tubular product in conveying is relieved and the tubular product is prevented from being snapped by a machining device; when the machining device stops receiving the tubular product, the motor continues to rotate, the tension of the tubular product is reduced till lost, after an action force of the tubular product on the treading rod is lost, the treading rod is pulled to the original position by the reset spring, the angle measuring sensor resends the signal to the controller, which controls the motor to stop rotating, and in this way, the tubular product is prevented from being knotted. The whole working process needs no artificial maintenance, the technical effects of automatically stopping feeding when the machining device stops receiving the tubular product and automatically starting feeding when the machining device is started to receive the tubular product, and the degree of automation of the production line is improved.

BRIEF DESCRIPTION OF THE DRAWINGS

In FIGS. 1-22: 1 unwinding mechanism, 11 base, 12 motor, 13 speed reducer, 14 material disc, 15 central rod, 16 blocking rod, 161 bending part, 17 bottom plate, 18 revolution bottom plate, 19 limiting device, 110 reset spring, 111 treading rod, 112 angle measuring sensor, 113 controller, 114 guiding heel, 115 blocking piece, 116 press disc, 117 spring fixing nail, 119 tubular product, 120 rotary shaft;

2 feeding straightening device, 21 rack, 22 feeding wheel, 23 straightening mechanism, 25 wire passing base, 231 straightening component, 232 straightening power system, 233 left end shaft, 234 straightening die, 235 left end shaft, 236 connecting block, 237 compression bolt, 24 length fixing mechanism, 241 measuring wheel, 242 revolution encoder;

3 cutting-off mechanism, 31 mounting base, 32 upright plate, 33 fixed shearing head, 34 shearing oil cylinder, 35 moving shearing head;

4 bending and molding device, 41 base, 42 transverse sliding rail, 43 transverse sliding base, 44 transverse driving device, 441 transverse driving motor, 442 gear, 45 central clamping device, 46 longitudinal sliding rail, 47 longitudinal sliding base, 48 longitudinal driving device, 481 longitudinal driving motor, 482 longitudinal lead screw, 483 coupler, 49 bending and molding device, 491 mounting base, 492 hollow shaft, 493 mandrel, 494 moving bending head, 495 fixed bending die, 496 fixed die motor, 497 driven synchronous belt wheel, 498 moving die motor, 499 main synchronous belt wheel, 410 left clamping device, 4101 left base, 4102 left sliding rail, 4103 left sliding base, 4104 left mounting base, 4105 clamping component, 4106 sliding cylinder, 411 right clamping cylinder, 4111 right base, 4112 right sliding rail, 4113 right sliding rail, 4114 right mounting base, 4115 clamping component 4116 sliding cylinder.

71 box body, 72 rotary gear disk, 73 power device, 731 servomotor, 732 right angle speed reducer, 74 transmission mechanism, 741 main synchronous belt wheel, 742 left synchronous belt wheel, 743 right synchronous belt wheel, 744 left transition gear, 745 right transition gear, 746 synchronous belt, 747 left transmission gear, 748 right transmission gear, 75 clamping mechanism, 751 left clamping block, 7511 left chuck, 7512 left pushing block, 752 right clamping block, 7521 right chuck, 7522 right pushing block, 753 left tension spring, 754 right tension spring, 755 reset pushing rod, 756 reset oil cylinder, 76 poking mechanism, 761 main poking shaft, 762 poking transmission shaft, 763 poking gear shaft, 764 main poking gear, 765 slave poking gear, 766 third poking gear, 767 poking cylinder, 768 rack, 769 rack compressing device, 7691 compressing shaft, 7692 idler wheel, 77 poking arm, 78 poking oil cylinder, 79 first transition shaft, 710 second transition shaft.

5 material loading mechanism, 51 end part mounting frame, 52 transmission shaft, 53 material holding arm, 54 pneumatic clamping component.

DETAILED DESCRIPTION

Specific implementing solutions of the present invention are described in detail in combination with the drawings.

Figure 1:
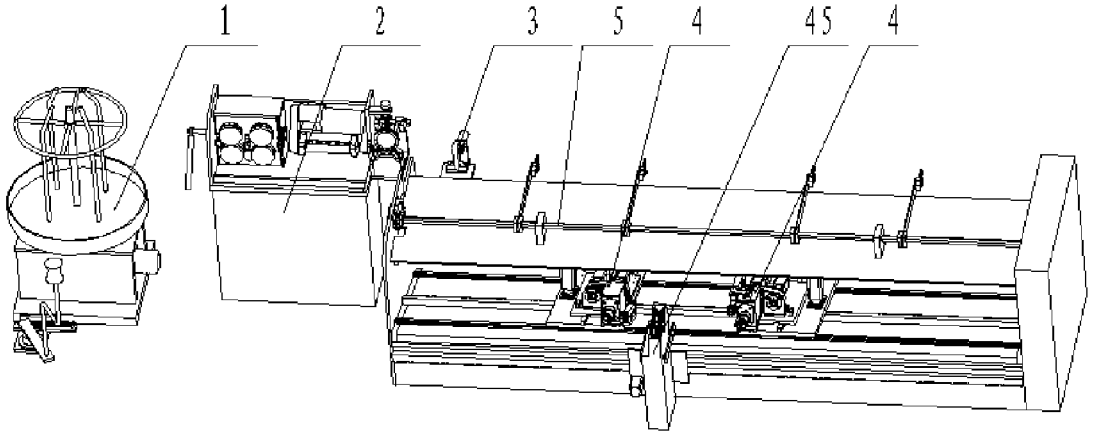
FIG. 1 is a three-dimensionally structural schematic view of the present invention.
Figure 2:
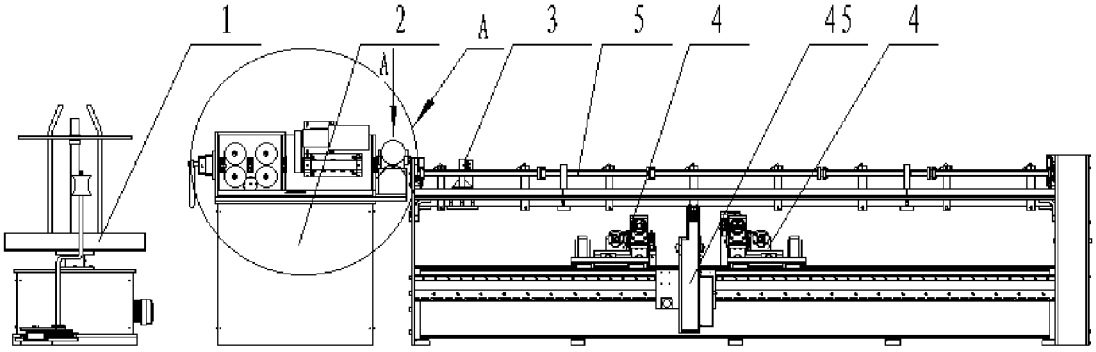
FIG. 2 is a main structural schematic view of the present invention.
Figure 3:
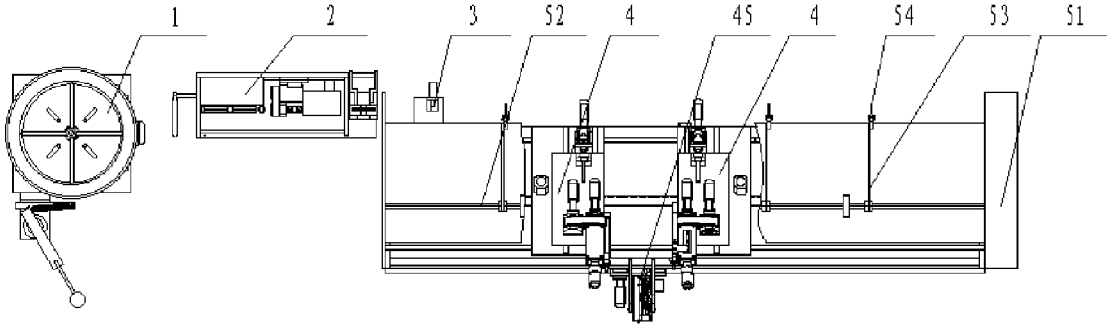
FIG. 3 is a top structural schematic view of the present invention.

As shown in FIGS. 1-3, a bending and molding production line comprises an unwinding mechanism 1, a feeding and straightening device 2, a cutting-off mechanism 3, a bending and molding device 4 and a material loading mechanism 5 for transferring the tubular product to the bending and molding device from the cutting-off mechanism.

As shown in FIGS. 8-11, the unwinding mechanism 1 comprises a box type base 11, a motor 12 and a speed reducer 13 connected to the motor 12 are disposed in the base 11, a material disc 14 is rotatably disposed on the base 11, the speed reducer 13 drives the material disc 14 to rotate, the material disc 14 is provided with a central rod 15 coaxial with an output shaft of the speed reducer 13, the material disc 14 is provided with at least three blocking rods 16, the blocking rods 16 are uniformly distributed around the central rod 15, the base 11 is also fixedly connected to a bottom plate 17, the bottom plate 17 is rotatably provided with a revolution bottom plate 18, the bottom plate 17 and the revolution bottom plate 18 are rotatably connected by a rotary shaft 120, the rotary shaft 120 is parallel with the central rod 15, a reset spring 110 is further disposed between the bottom plate 17 and the revolution bottom plate 18, one end of the reset spring 110 is fixedly connected on the bottom plate 17, the other end of the reset spring is fixedly connected to the revolution bottom plate 18, the upper surface of the revolution bottom plate 18 is connected to a treading rod 111 guiding a moving trend of the tubular product, the treading rod 111 and the central rod 15 are matched, the top end of the treading rod 111 is provided with a limiting device 19 preventing the tubular product from being separated from the treading rod 111, the revolution bottom plate 18 is further provided with an angle measuring sensor 112 for measuring a swing angle of the treading rod 111, the base 11 is provided with a controller electrically connected to the angle measurement sensor 112, and the controller 113 is used for controlling operation of the motor 12.

When the tension of a tubular product 119 in conveying is increased to draw the treading rod 111 to swing by an angle, the angle measuring sensor 112 can send a signal to the controller 113, and the controller 113 can control the motor 12 to start to release a coil 118 on the material disc 14, such that the tension of the tubular product 119 in conveying is relieved and the tubular product 119 is prevented from being snapped by a machining device; when the machining device stops receiving the tubular product 119, the motor 12 continues to rotate, the tension of the tubular product 119 is reduced till lost, after an action force F of the tubular product 119 on the treading rod 111 is lost, the treading rod is pulled to the original position by the reset spring 110, the angle measuring sensor 112 resends the signal to the controller 113, which controls the motor 12 to stop rotating, and in this way, the tubular product 119 is prevented from being knotted.

Figure 8:
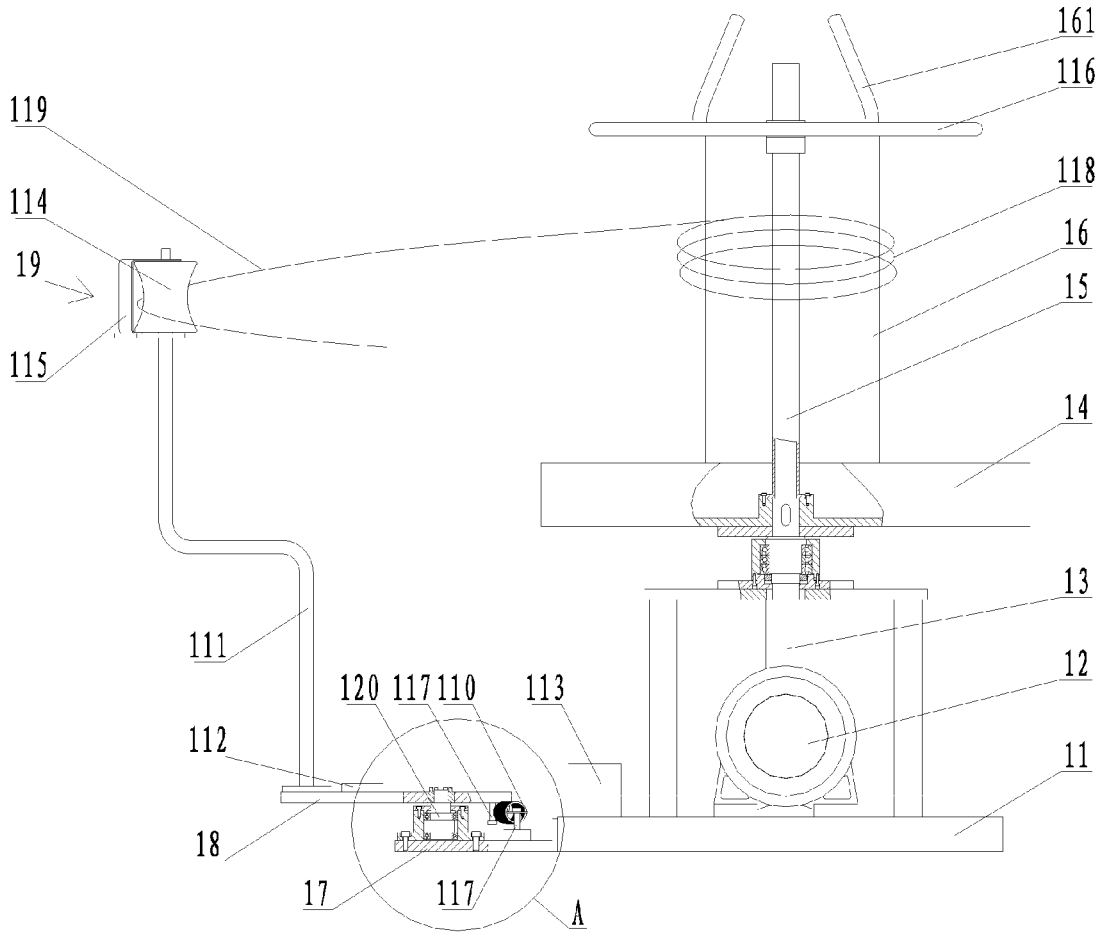
FIG. 8 is a structural schematic view of an unwinding mechanism of the present invention.
Figure 9:
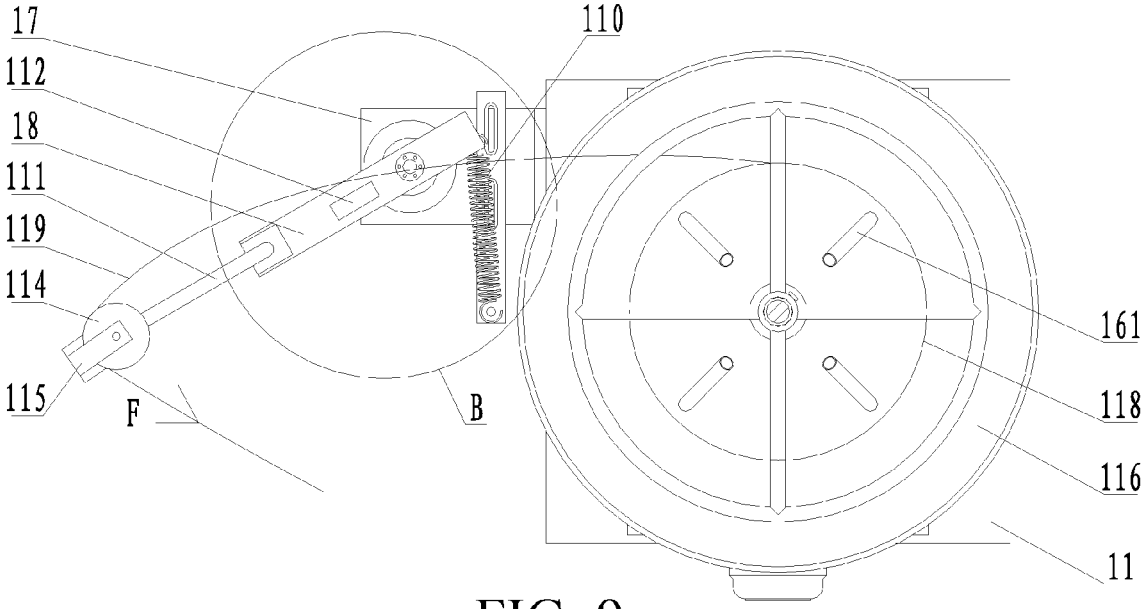
FIG. 9 is a top view of FIG. 8.

As shown in FIGS. 8 and 9, the limiting device 19 comprises a guiding wheel 114 rotatably disposed on the top of the treating rod 111, one side of the guiding wheel back onto the central rod 15 is provided with a blocking piece 115 fixedly connected on the treading rod 111, and a gap allowing the tubular product to penetrate through is formed between the guiding wheel 114 and the blocking piece 115.

As shown in FIGS. 8 and 9, the central rod 15 is detachably connected to a pressing disc 116, the pressing disc 116 is opposite to the material disc 14 and can prevent the tubular product 119 from being separated out of the central rod 15 when the coil 118 rotates.

Figure 10:
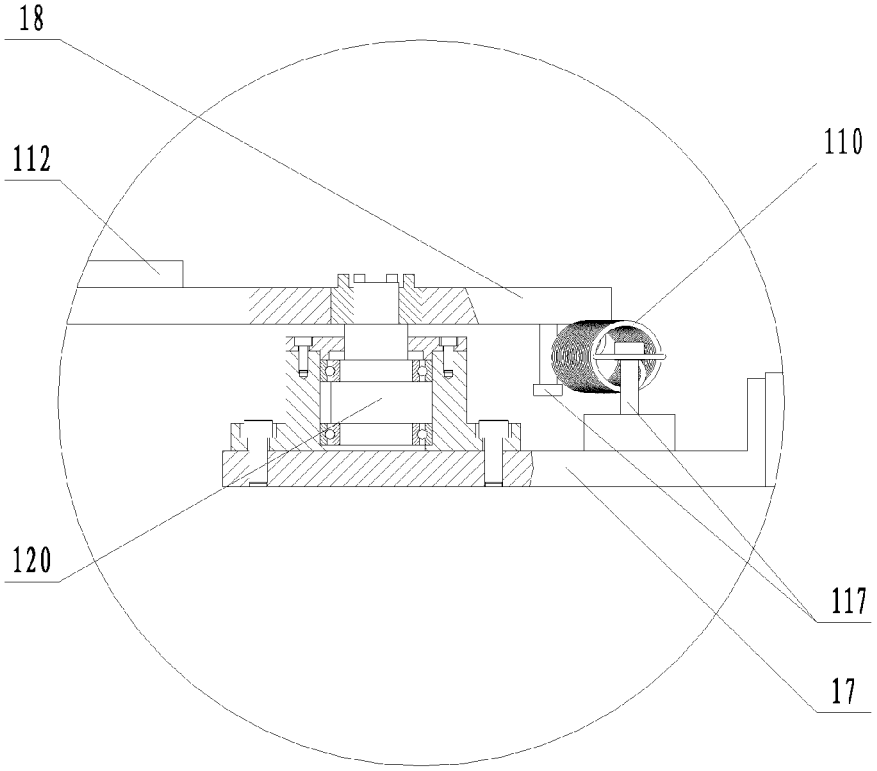
FIG. 10 is an enlarged view of an A part in FIG. 8.
Figure 11:
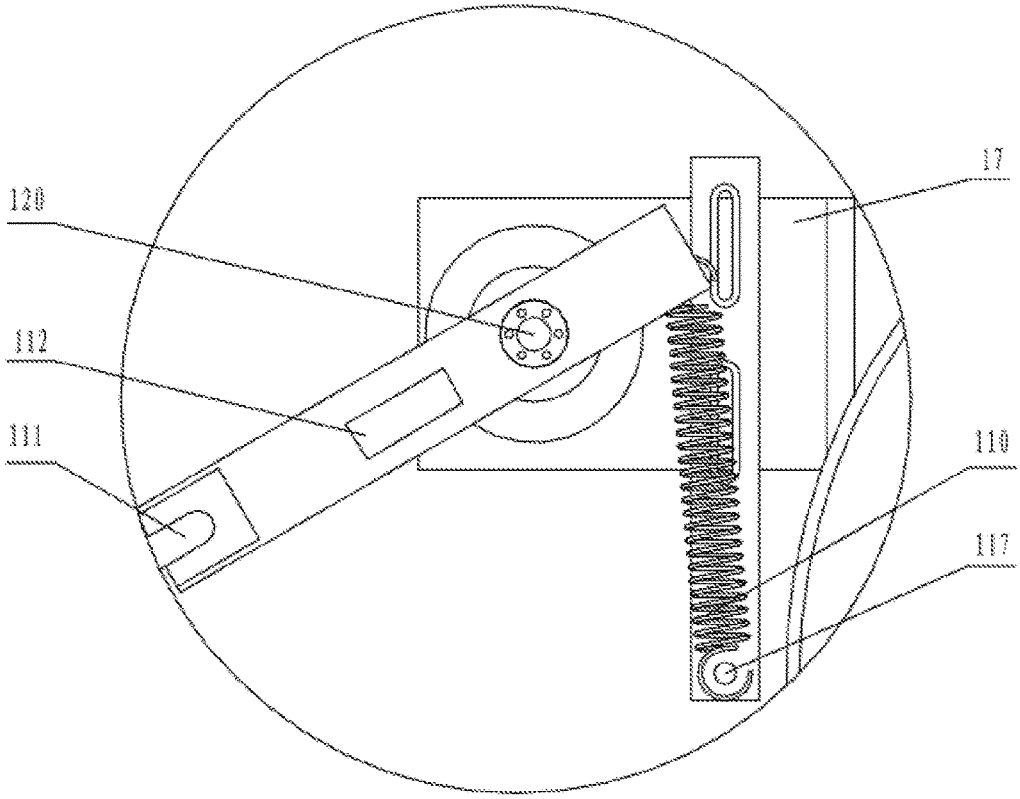
FIG. 11 is an enlarged view of a B part in FIG. 9.
Figure 12:
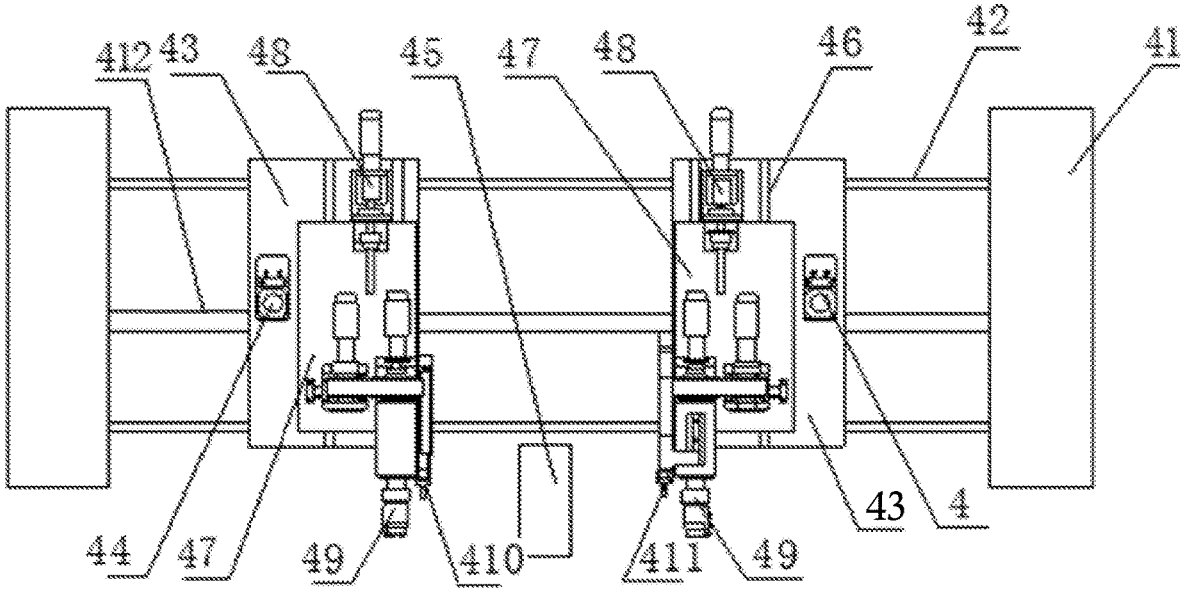
FIG. 12 is a structural schematic view of a bending and molding device in the present invention.
Figure 13:
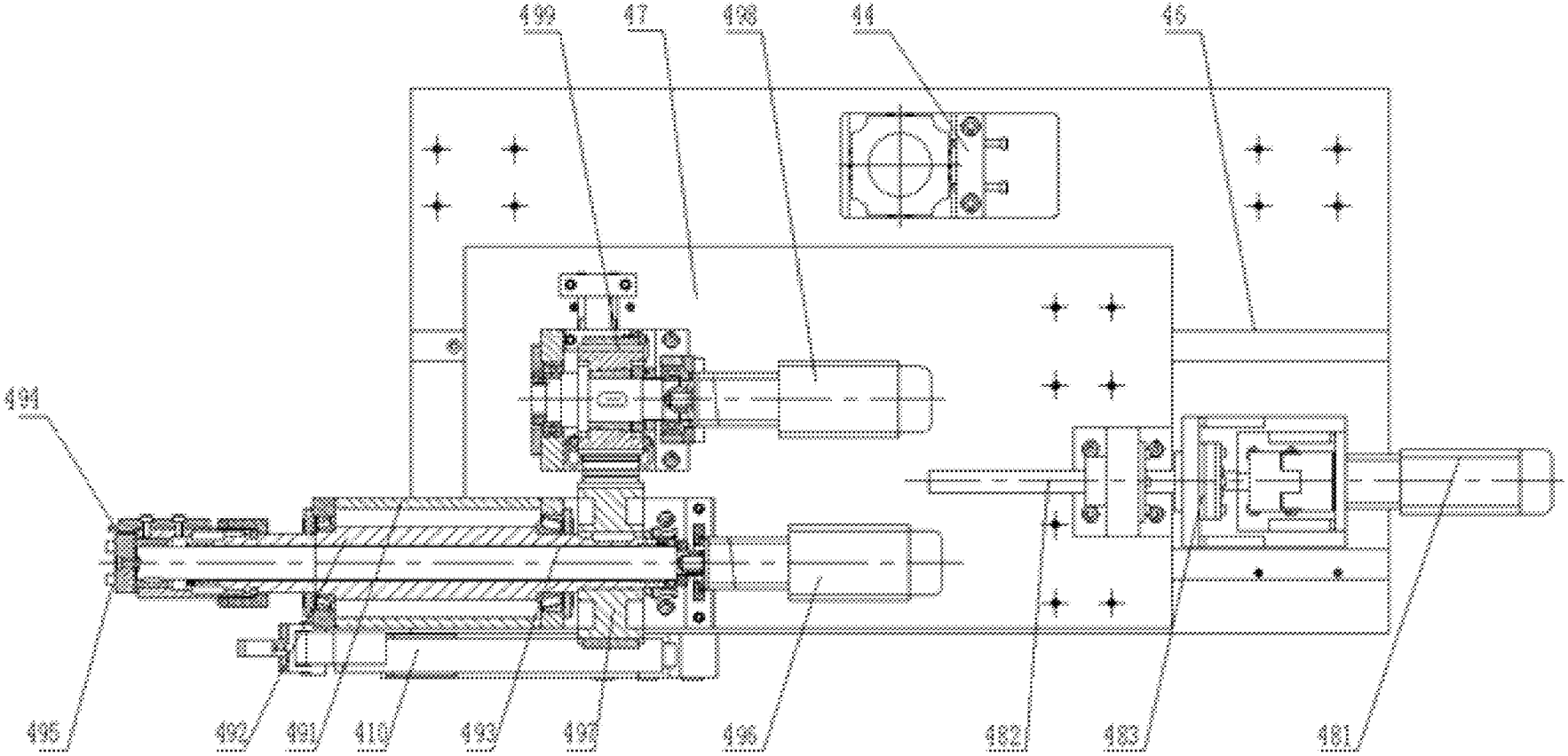
FIG. 13 is a top structural schematic view of a transverse sliding base and parts thereon at the left side in the bending and molding device.
Figure 14:
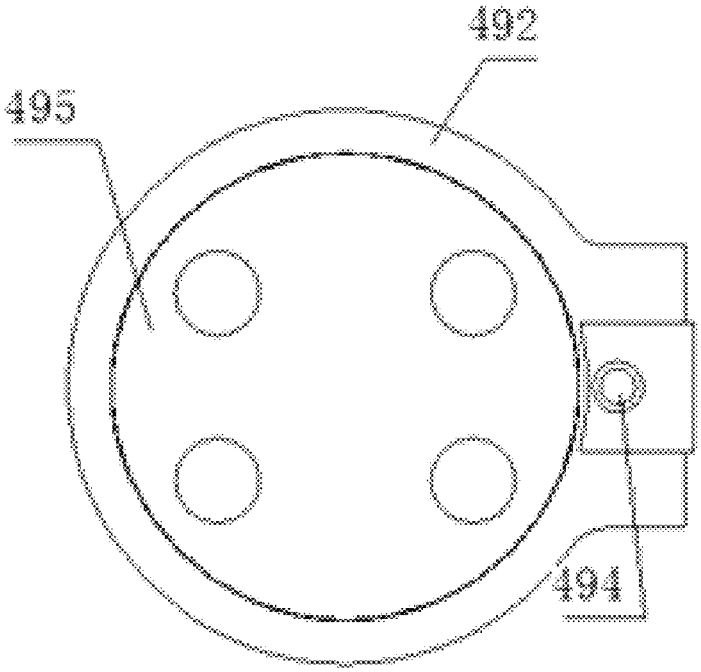
FIG. 14 is a structural schematic view of an end surface of a bending and molding device at the right side in the bending and molding device.
Figure 15:
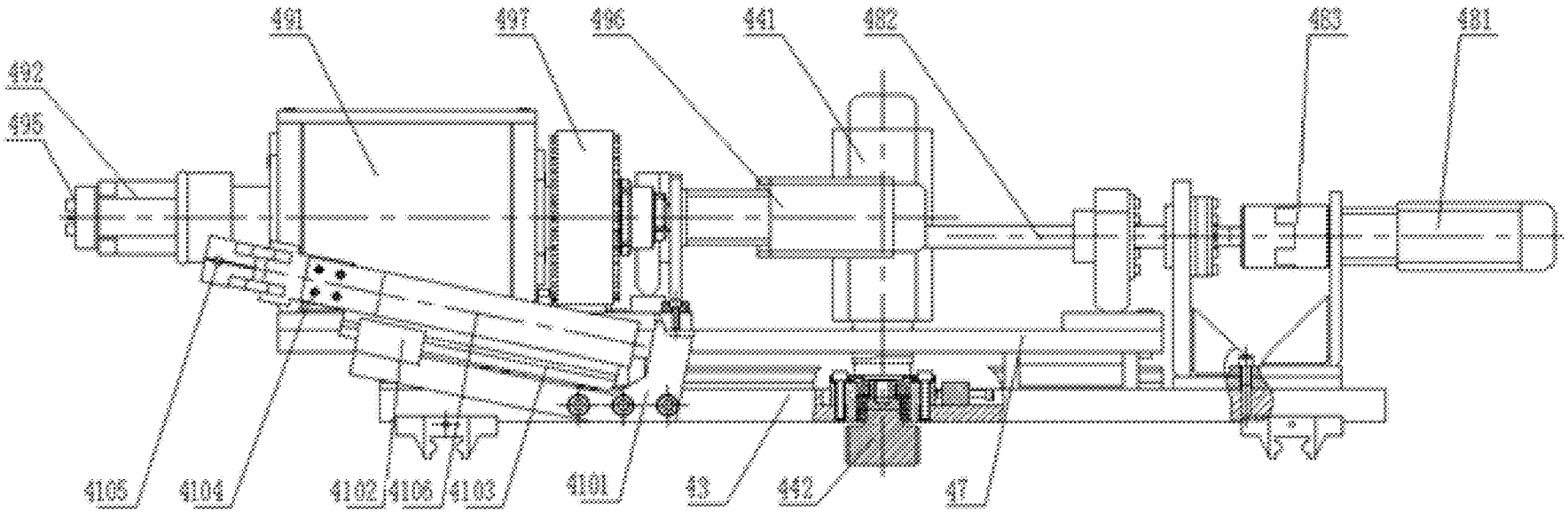
FIG. 15 is a right structural schematic view of the transverse sliding base and the parts thereon at the left side in the bending and molding device.
Figure 16:
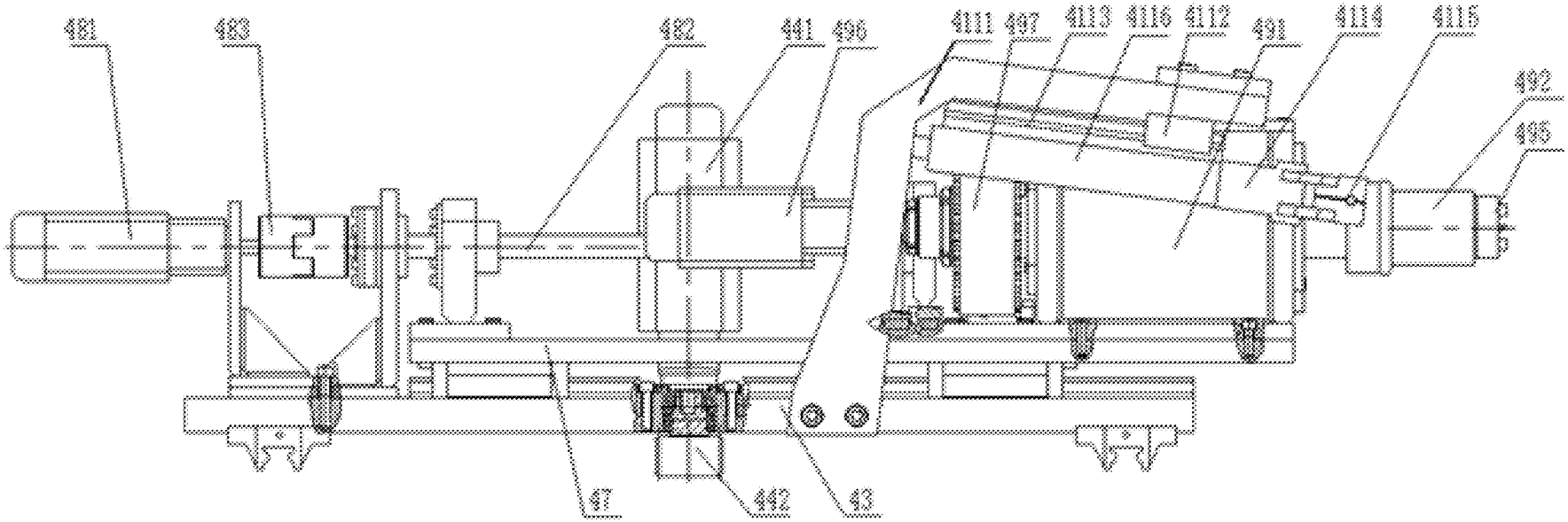
FIG. 16 is a left structural schematic view of a transverse sliding base and parts thereon at the right side in the bending and molding device.

As shown in FIG. 10, the bottom plate 17 is provided with a spring fixing nail 117, the revolution bottom plate 18 is correspondingly provided with another spring fixing nail 117, and the two spring fixing nails 117 are mutually staggered, the reset spring 110 is a tension spring, and both ends of the tension spring are connected to a spring fixing nail 117 respectively.

The reset spring 110 can be restored to an initial state when the treading rod 111 loses the action force of the tubular product, such that the angle measuring sensor sends a signal to the controller 113, the controller 113 controls the motor to stop rotating, and the tubular product is prevented from being charged without limitation to cause accumulation and deformation of the tubular product.

A specific working process of the unwinding mechanism is: when the subsequent machining device (the feeding and straightening device 2 in the present production line) pulls the tubular product 119 actively, the tension of the tubular product 119 is increased, a pull force F toward an advancing direction of the tubular product 119 is generated for the treading rod 111, under the action of the pull force F, the treading rod 111 drives the revolution bottom plate 18 to swing to the advancing direction of the tubular product 119 gradually, the reset spring 110 is stretched, the angle measuring sensor 112 measures the swing angle and sends a signal to the controller 113, when the swing angle reaches a preset starting value, the controller 113 starts the motor 12 which drives the speed reducer 13 to rotate, the speed reducer 13 drives the material disc 14 and the coil 18 on the material disc to rotate, the section of tubular product 119 between the coil 118 and the machining device is loosened, the tension of the tubular product 119 is reduced, the pull force F acting on the treading rod 111 is reduced therewith, under the pull force of the reset spring 110, the treading rod 111 is gradually restored to the original position, the angle measuring sensor 112 measures the swing angle in real time and transmits to the controller 113, and when the swing angle reaches a preset stop value, the controller 113 controls the motor 12 to stop rotation.

The treading rod 111 can realize swing, such that the tubular product 119 can be buffered when being actively pulled by the machining device, the treading rod 111 or treading rod 119 is prevented from damage due to a large stress, the angle measuring sensor 112 is used to measure the swing angle of the treading rod 111 in real time and control the motor, excessive loosing of the tubular product 119 is prevented, and the tubular product 119 is prevented from being knotted.

Figure 4:
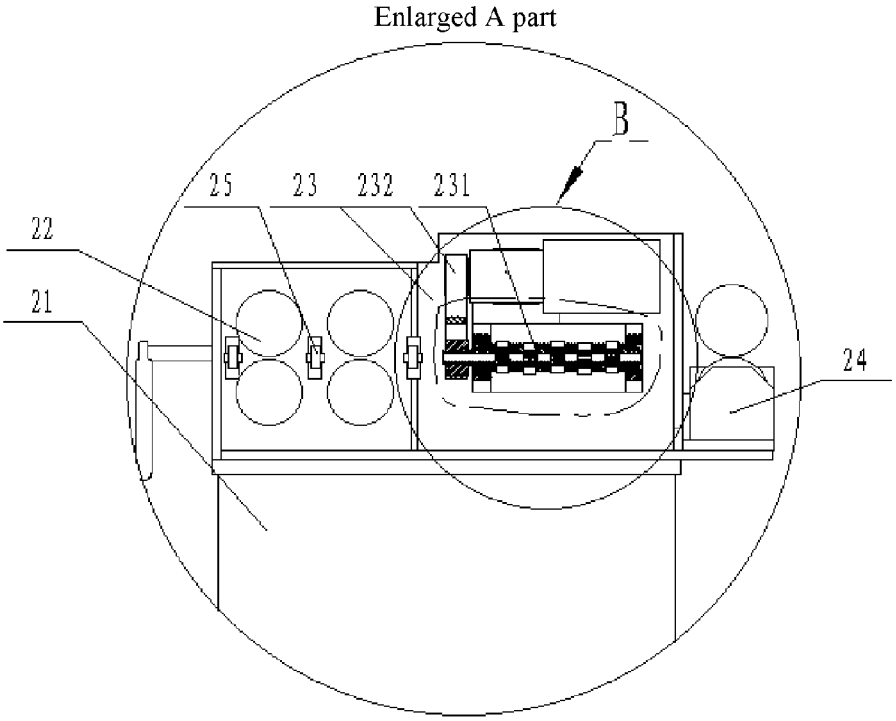
FIG. 4 is an enlarged structural schematic view of an A part in FIG. 2.
Figure 5:
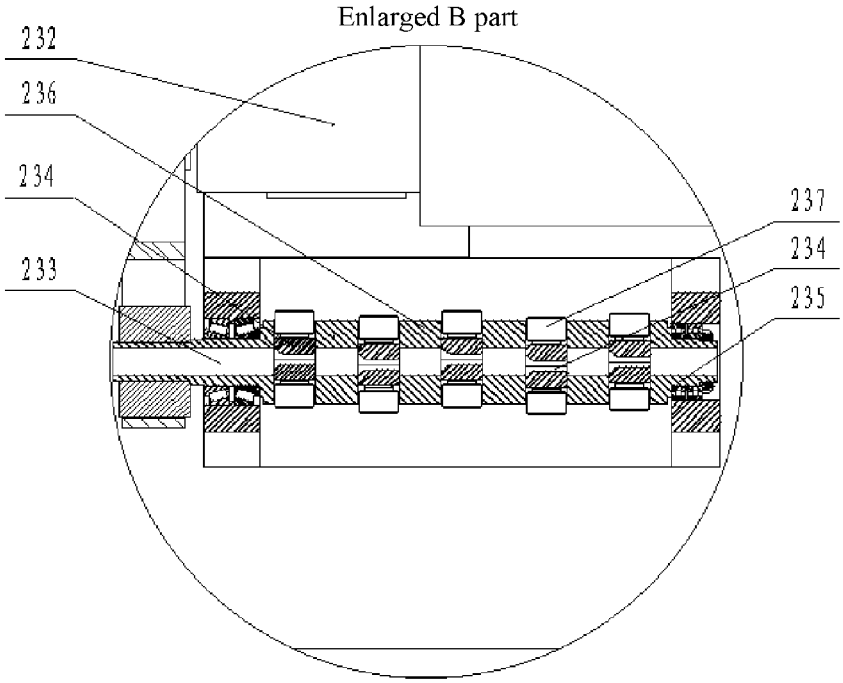
FIG. 5 is an enlarged structural schematic view of a B part in FIG. 4.
Figure 6:
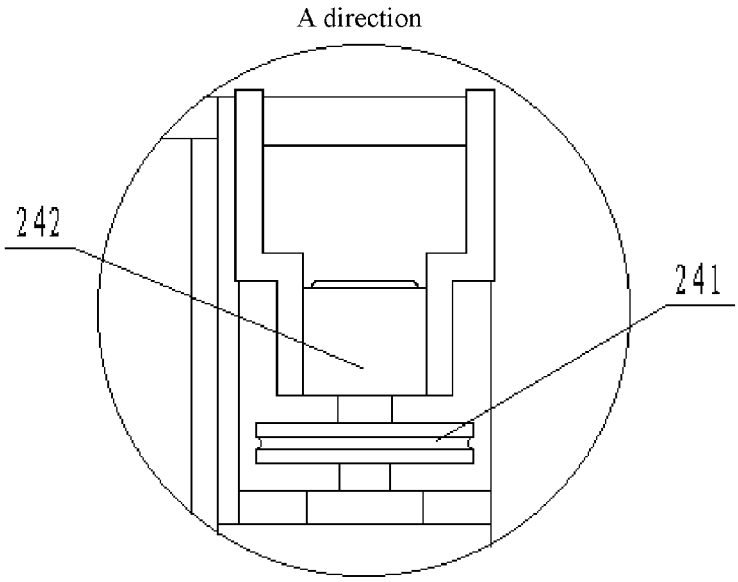
FIG. 6 is an enlarged structural schematic view of an A direction in FIG. 2.

As shown in FIGS. 4-6, the feeding straightening device 2 comprises a rack 21, the rack 21 is provided with two pairs of feeding wheels 22, a straightening mechanism 23 and a length fixing mechanism 24 along a straight line in sequence, a wire passing base 25 is disposed at the front part of the feeding wheels 22, between the two pairs of the feeding wheels 22 and between the feeding wheels 22 and the straightening mechanism 23 on the rack 21 respectively, the straightening mechanism 23 comprises a hollow shaft-like straightening component 231 rotatably disposed on the rack 21 and a straightening power system 232 driving the hollow shaft-like straightening component 231 to rotate, the hollow shaft-like straightening component 231 comprises a hollow left end shaft 233, five straightening dies 234 and a hollow right end shaft 235, the left end shaft 233 and the right end shaft 235 are rotatably disposed on the rack 21 respectively, a connecting block 236 with a material passing hole in the middle is disposed among the adjacent straightening dies 234, the positions of the straightening dies 234 meet a condition that the central lines of all straightening dies 234 are in staggered arrangement relative to the axis of the left end shaft 233, the straightening die 234 comprises two straightening modules provided with semicircular slots matched with the diameter of the tubular product to be straightened, connecting surfaces of the left end shaft 233, the connecting blocks 236 and the right end shaft 235 matched with the straightening dies are provided a mounting groove matched with the shape of the straightening die 234 and an arc slot located for compressing compression bolts 237 of the straightening dies and internally provided with a plurality of threaded sections respectively, the length fixing mechanism 24 comprises a pair of measuring wheels 241 driven by the tubular product to rotate and placed on the rack 21, and one of the measuring wheels 241 is connected to a revolution encoder 242.

Figure 7:
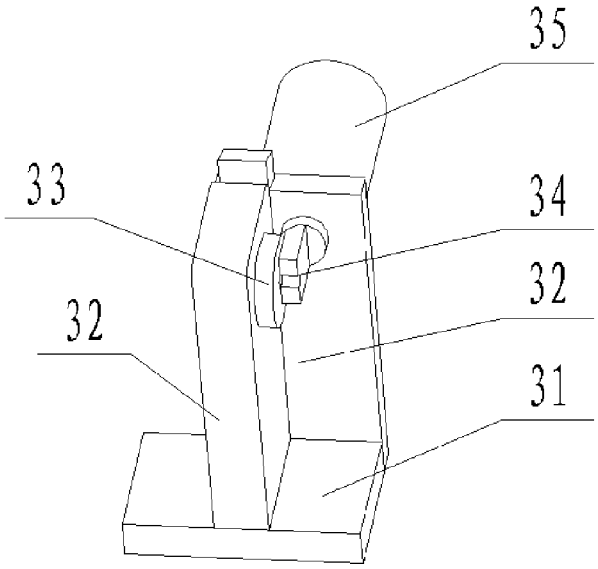
FIG. 7 is a structural schematic view of a cutting-off mechanism of the present invention.

As shown in FIG. 7, the cutting-off mechanism 3 comprises a mounting base 31, the mounting base 31 is provided with two upright plates 32 vertical to each other, one upright plate 32 is provided with a fixed shearing head 33, the other upright plate 32 parallel with a feeding direction is provided with a shearing oil cylinder 34 and the end part of the piston rod of the shearing oil cylinder 34 is provided with a moving shearing head 35 matched with the fixed shearing head 33.

As shown in FIG. 3, the material loading mechanism 5 comprises two end part mounting frames 51 disposed on two ends of the base of the bending and molding device respectively, the end part mounting frames 51 are provided with a transmission shaft 52 and a charging power device driving the transmission shaft 52, the transmission shaft 52 is provided with at least two material holding arms 53 in parallel, the end part of each material holding arm 53 is provided with a pneumatic clamping component 54 which is controlled by a cylinder to open or clamp, the positions of the material holding arms 53 are matched with the positions where the cutting-off mechanism 3 and the central camping mechanism charge the tubular product.

As shown in FIGS. 12-16, the bending and molding device 4 comprises a base 41, the base 41 is provided with a transverse sliding rail 42, two transverse sliding bases 43 are disposed on the transverse sliding rail 42 in a sliding manner, and the base 41 is provided with a transverse driving device 44 driving the transverse driving bases 43. The transverse driving device 44 comprises a rack disposed on the base 41, the transverse sliding base 43 is provided with a transverse driving motor 441, and an output shaft of the transverse driving motor 441 downwards penetrates out of the transverse sliding base 43 and is connected to a gear 442 matched with the rack thereon. The base 41 is provided with a central clamping device 45 which can clamp the tubular product and can rotate around a central axis of the tubular product between the two transverse sliding bases 43.

The transverse sliding base 43 is provided with a longitudinal sliding rail 46, the longitudinal sliding rail 46 is provided with a longitudinal sliding base 47 in a sliding manner, and the transverse sliding base 43 is provided with a longitudinal driving device 48 driving the longitudinal sliding bases 47 to slide. The longitudinal driving device 48 comprises a longitudinal driving motor 481 disposed on the transverse sliding base 43, the longitudinal sliding base 47 is provided with a longitudinal lead screw 482, and the longitudinal driving motor 481 is connected to the end part of the longitudinal lead screw 482 through a coupler 483. The longitudinal sliding base 47 is provided with a bending and molding device 49.

The bending and molding device 49 comprises a hollow mounting base 491 rotatably disposed on the longitudinal sliding base 47, a hollow shaft 492 is rotatably disposed in the mounting base 491 in a penetrating manner, a mandrel 493 is rotatably disposed in the hollow shaft 492 in a penetrating manner, one end of the hollow shaft 492 and one end of the mandrel 493 extend out of the longitudinal sliding base 47, the hollow shaft 492 is provided with a moving bending head 494 at this end, the end part of the moving bending head 494 is cylindrical and its periphery is provided with a circle of groove matched with the tubular product to be matched, the mandrel 493 is detachably provided with a bending die 495 at this end, the fixed bending die 495 is provided with four cylindrical fixed bending modules of which the connecting lines are in a rectangle, an interval between two rows of fixed bending modules is matched with a diameter of the tubular product to be bent, the other end of the mandrel 493 is connected to a fixed die motor 496 disposed on the longitudinal sliding base 47, a driven synchronous bent wheel 497 sleeves the periphery of the other end of the hollow shaft 492, the longitudinal sliding base 47 is provided with a moving die motor 498, an output shaft of the moving die motor is provided with a driving synchronous belt wheel 499 matched with the driven synchronous belt wheel 497, and a synchronous belt sleeves the driven synchronous belt wheel 497 and the driving synchronous belt wheel 499.

One side, close to the central clamping device 45, of the transverse sliding base 43 at the left side is provided with a left clamping device 410 capable of movably extending to clamp the tubular product. The left clamping device comprises a left base 4101 disposed on the longitudinal sliding base 47 at the left side, a certain included angle exists between the upper surface of the longitudinal sliding base and the left base, the upper surface of the left base 4101 is provided with a left sliding rail 4102, the left sliding rail 4102 is provided with a left sliding base 4103, the left sliding base 4103 is provided with a left mounting base 4104, the left mounting base 4104 is provided with a clamping component 4105 driven by a clamping cylinder to open or clamp, and the left base 4101 is provided with a sliding cylinder 4106 driving the left sliding base 4103 to drive the clamping component 4105 to approach to the tubular product from bottom to top;

One side, close to the central clamping device 45, of the transverse sliding base 43 at the right side is provided with a right clamping device 411 capable of movably extending to clamp the tubular product. The right clamping device comprises a right base 4111 disposed on the longitudinal sliding base 47 at the right side, a certain included angle exists between the upper surface of the longitudinal sliding base and the right base, the right base 4111 is provided with a right sliding rail 4112, the right sliding rail 4112 is provided with a right sliding base 4113, the right sliding base 4113 is provided with a right mounting base 4114, the right mounting base 4114 is provided with a clamping component 4115 driven by a clamping cylinder to open or clamp, and the right base 4111 is provided with a sliding cylinder 4116 driving the right sliding base 4113 to drive the clamping component 4115 to approach to the tubular product from top to bottom.

A specific working process of the bending and molding device 4 is: when the material loading mechanism 5 places the well prepared tubular product onto the central clamping device 45, the left and right transverse sliding bases move at the same time and begin to bend the tubular product from two ends to the middle section by section.

The moving process of the transverse sliding base 43 at the left side is described in detail, when the tubular product is placed on the central clamping device 45, a signal receiver on the central clamping device 45 sends a signal to the controller, the controller drives the longitudinal driving motor 481 to rotate so as to drive the longitudinal lead screw 482 to rotate, and the longitudinal sliding base 47 is pushed to extend forwards to reach to a designated bending position. Meanwhile, the clamping component 4105 is pushed by the sliding cylinder 4106 to extend out and reach a corresponding position to clamp the tubular product. At this point, the transverse driving motor 441 rotates to drive the gear 442 and rack mechanism to move, and the transverse sliding bases 43 are transversely moved to the designated bending position. Bending is started, the moving die motor 498 drives the hollow shaft 492 to rotate, and the moving bending head 494 at the front end of the hollow shaft 492 rotates therewith to bend the tubular product.

When space bending is required, only the central clamping device 45 is required to rotate the tubular product by a corresponding angle, then the transverse driving motor 441 drives the transverse sliding base 43 to reach a corresponding bending section position, and further the tubular product is bent.

When a bending radius or a angle bending shape needs to be corrected or the raw material of the used tubular product is bent per se, and certain section, a certain angle is formed between which and the central clamping device 45, on the tubular product needs to be bent, the longitudinal driving motor 481 rotates reversely, the longitudinal lead screw 482 rotates therewith and drives the longitudinal sliding base 47 to return, at this point, the fixed die motor 496 drives the mandrel 493 to rotate for a required angle, the fixed bending die 495 at the front end of the mandrel 493 rotates to a corresponding angle therewith, then the longitudinal driving motor 491 pushes the longitudinal slide base 47 to reach a bending position to locate a section to be bent between the two rows of fixed bending dies, and then the tubular product is bent to change the bending radius or the angle bending shape.

After the required bending action is finished, the clamping component 4105 is loosened and returned, meanwhile, the longitudinal driving motor 481 rotates backwards, the longitudinal lead screw 482 rotates and drives the longitudinal sliding base 47 to return back to the initial position, and then the transverse driving motor 441 drives the transverse sliding base 43 to retreat to the initial position.

If the diameter of the tubular product to be bent changes, then the fixed bending die 45 is directly replaced.

The central clamping device 45 as shown in FIGS. 17-22 comprises a box body 71, a rotary gear disk 72 rotatably disposed on the box body 71, a power device 73 disposed on the box body 71, a transmission mechanism 74 connected to the rotary gear disk 72 and the power device 73, and a clamping mechanism 75 disposed on the rotary gear disk 72 for clamping the tubular product, wherein the transmission mechanism 74 comprises a main synchronous belt wheel 741 fixedly connected on an output shaft of the power device 73, a left transition gear 744 and a right transition gear 745 which are meshed with the rotary gear disk 72 respectively, a left transmission gear 747 meshed with the left transition gear 744, a right transmission gear 748 meshed with the right transmission gear 74, a left synchronous belt wheel 742 coaxial and capable of synchronously rotating with the left transmission gear 747, a right synchronous belt wheel 743 coaxial and capable of synchronously rotating with the right transmission gear 748 and a synchronous belt 746 connected to the main synchronous belt wheel 741, the left synchronous belt wheel 742 and the right synchronous belt wheel 743, the left transition gear 744 is connected on the box body 71 by a first transition shaft 79, and the right transition gear 745 is connected on the box body 71 by a second transition shaft 710.

The transmission mechanism 74 is driven by the synchronous belt 746, has a buffering and damping action, stable transmission is realized by the meshing between the left transition gear 744 and the right transition gear 745 and the rotary gear disk 72, the error of the rotary gear disk 72 generated in forward and backward rotation processes is eliminated, and the rotation precision is improved.

Figure 17:
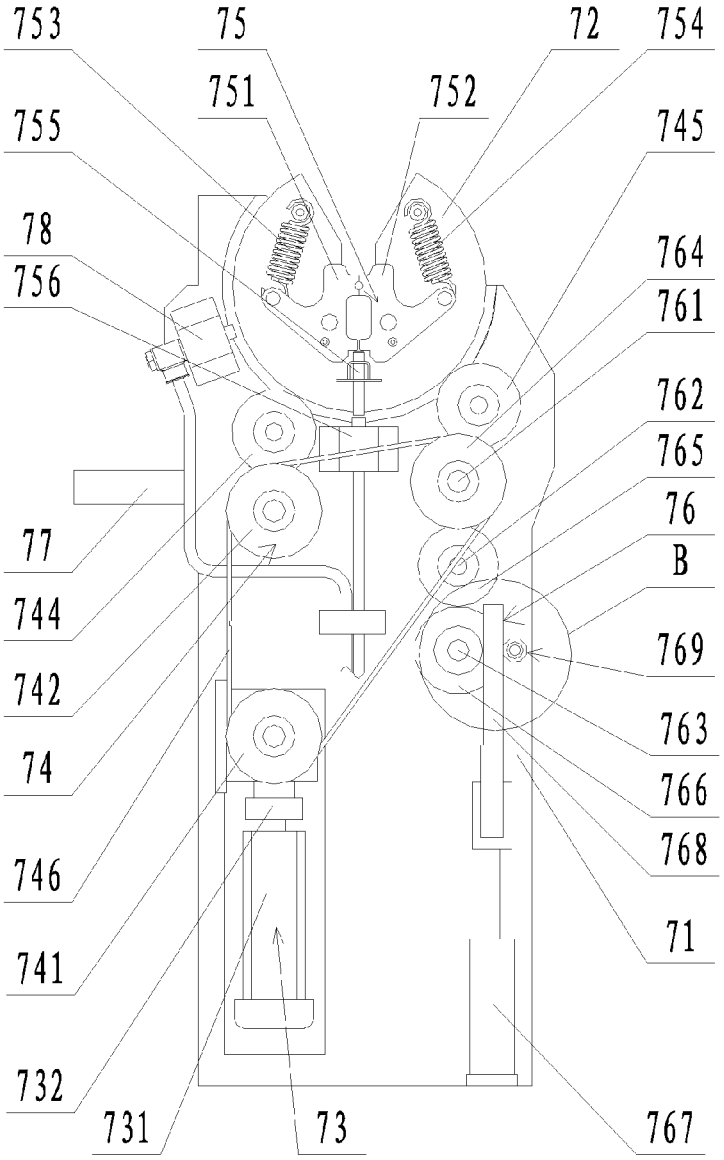
FIG. 17 is a main sectional view of a central clamping device in the present invention.
Figure 18:
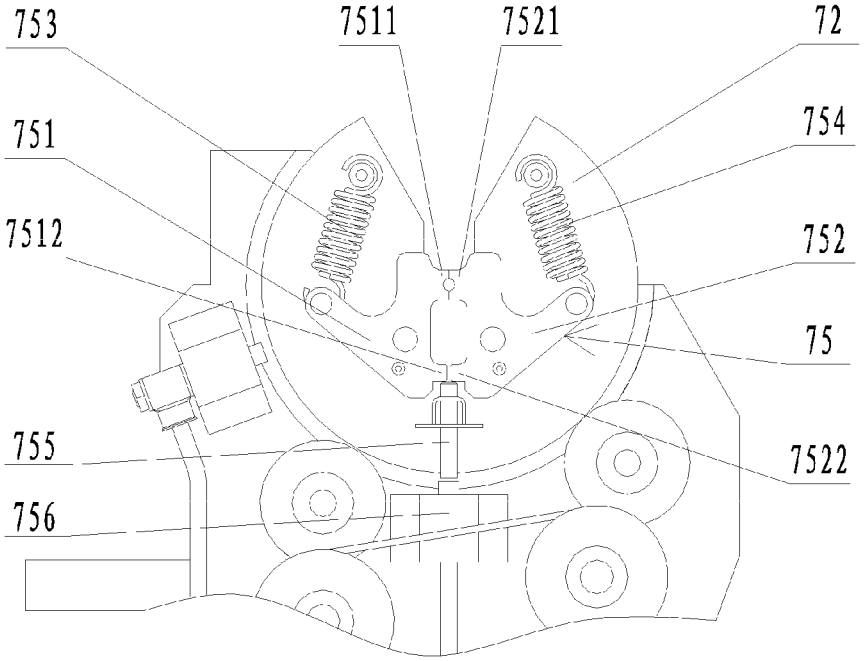
FIG. 18 is an enlarged schematic view of a clamping mechanism in FIG. 17.

As shown in FIGS. 17 and 18, the clamping mechanism 75 comprises a left clamping block 751 and a right clamping block 752; the left clamping block 751 and the right clamping block 752 are respectively symmetrically connected to a disc surface of the rotary gear disk, the opposite sides of the left clamping block 751 and the right clamping block 752 are respectively provided with a left chuck 7511 and a right chuck 7521, the lower part of the left clamping block 751 located on the left chuck 7511 is provided with a left pushing block 7512, the lower part of the right clamping block 752 located on the right chuck 7521 is provided with a right pushing block 7522, the sides, back onto each other, of the left clamping block 751 and the right clamping block 752 are connected to the rotary gear disk 72 by a left tension spring 753 and a right tension spring 754, the left chuck 7511 and the right chuck 7521 are matched, the left tension spring 753, a pull force of the left tension spring 753 and the right tension spring 754 drives the left chuck 7511 and the right chuck 7521 to abut against each other, the left pushing block 7512 and the right pushing block 7522 are mutually symmetric, a reset pushing rod 755 and a reset oil cylinder 756 driving the reset pushing rod 755 are disposed below the left pushing block 7512 and the right pushing block 7522, the reset pushing rod 755 pushes the left pushing block 7512 and the right pushing block 7522 when upwards pushing, the left clamping block 751 and the right clamping block 752 are promoted to rotate, and the left chuck 7511 and the right chuck 7521 are promoted to be separated.

The clamping mechanism 75 adopts a spring self-clamping structure, and is simple in structure and stable in clamping force, the reset pushing rod 755 is pushed by a piston rod of the reset oil cylinder 756 to further open the clamping mechanism 75, such that separation between power and the structure is realized, and the stability of the clamping mechanism 75 in the rotation process of the rotary gear disk 72 is ensured.

As shown in FIG. 18, abutting against each other, the left chuck 7511 and the right chuck 7521 form a ring containing the tubular product, the center of the ring and a rotation center of the rotary gear disk 73 are coincided, and a rotation precision of the tubular product is improved.

The power device 73 comprises a servomotor 731 and a right angle speed reducer 732 connected to the servomotor 731, so not only is a rotary speed of the rotary gear disk 71 controlled, but also the rotation precision is further improved.

Figure 19:
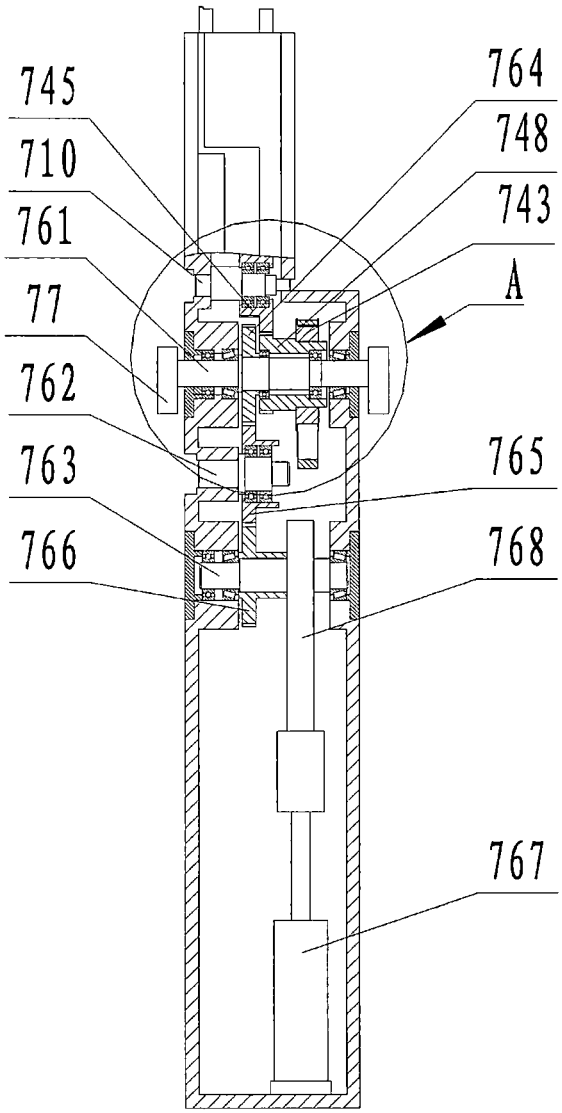
FIG. 19 is a right schematic view of FIG. 17.
Figure 20:
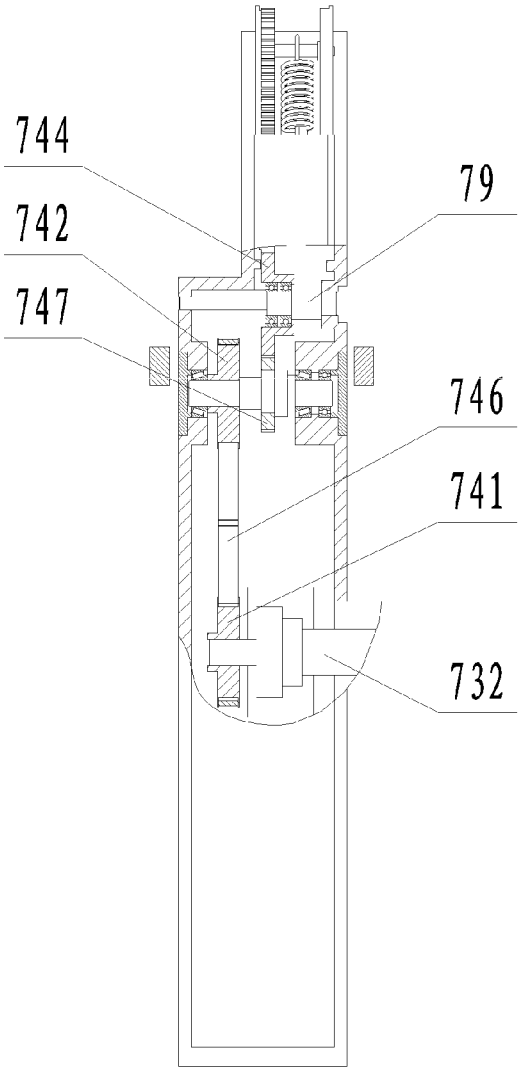
FIG. 20 is a left view of FIG. 17.
Figure 21:
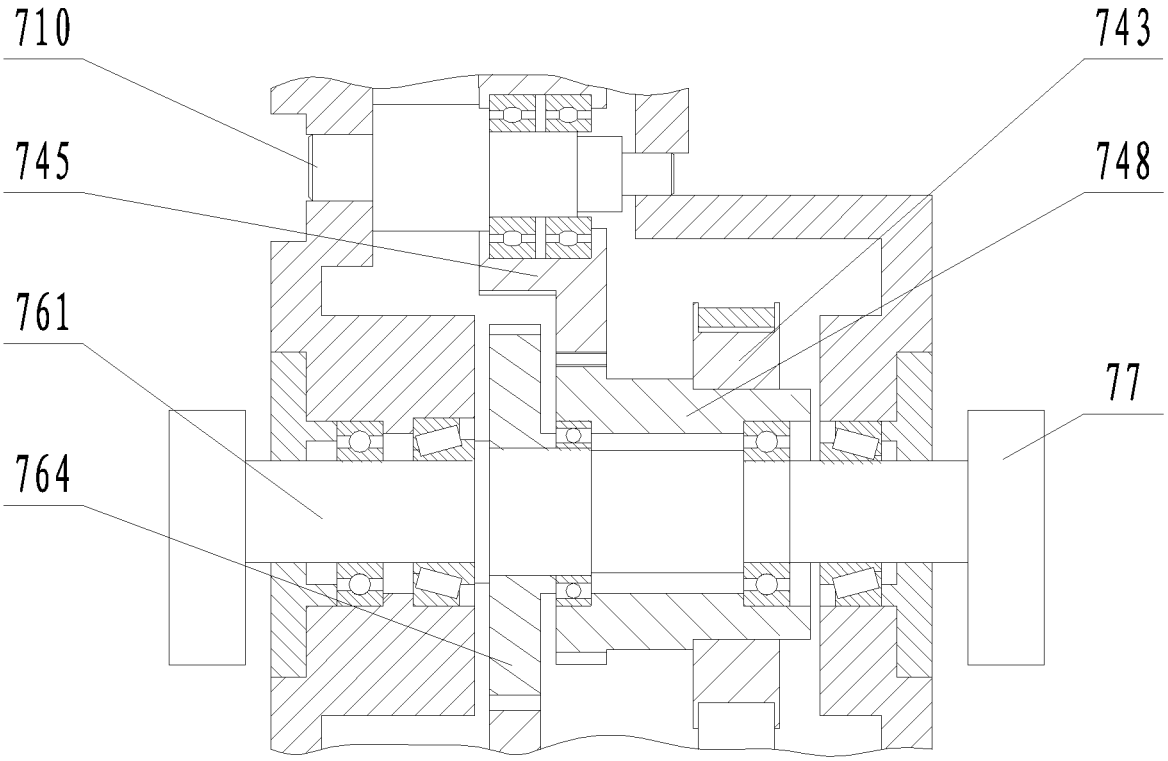
FIG. 21 is an enlarged view of an A part in FIG. 19.

As shown in FIGS. 17, 19 and 21, the center clamping device also comprises a poking mechanism 76 for unloading, wherein the poking mechanism 76 comprises a main poking shaft 761 vertical to the rotary gear disk 72, a poking transmission shaft 762 parallel with the main poking shaft 761 and fixedly connected on the box body 71, and a poking gear shaft 763 parallel with the main poking shaft 761 and rotatably connected on the box body, the main poking shaft 761 is in rotary connection with the box body 71, two ends of the main poking shaft 761 extend out of the box body 71 respectively and are connected to a poking arm 77 outside the box body 71 respectively, a main poking gear 764 is fixedly disposed on the main poking shaft 761 in the box body 71, a slave poking gear 765 is rotatably disposed on the poking transmission shaft 762, the poking gear shaft 763 is provided with a third poking gear 766, the main poking gear 764 is meshed with the slave poking gear 765, the salve poking gear 765 is meshed with the third poking gear 766, the poking mechanism also comprises a poking cylinder 767 fixed in the box body and a rack 768, the rack 768 is connected to the poking cylinder 767 and performs telescopic movement along with the poking cylinder 767, the rack 768 is meshed with the poking gear shaft 763, one side, back onto the poking gear shaft 763, on the rack 768 is further provided with a rack compressing device 769 compressing the rack 768 on a poking driving gear on the poking gear shaft 763; and the box body 71 is further internally provided with a poking oil cylinder 78 capable of driving the reset pushing rod 755.

Figure 22:
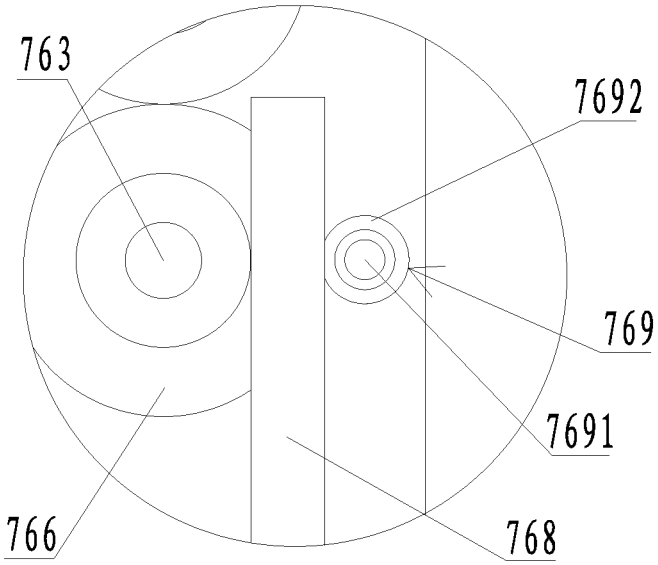
FIG. 22 is an enlarged view of a B part in FIG. 17.

The rack compressing device 769 as shown in FIG. 22 comprises a compressing shaft 7691 fixedly connected on the box body 71 and an idler wheel 7692 rotatably connected on the compressing shaft 7691, and the idler wheel 7692 abuts against the rack 768 and moves along a movement direction of the rack 768.

By increasing the poking mechanism, automatic unloading is realized, the degree of automation is realized, and the labor cost is reduced; due to the rack compressing device 769, the rack 768 can be accurately meshed with a poking driving gear on the poking gear shaft 763, and the transmission stability of the rack is realized.

As shown in FIG. 21, the right transmission gear 748 rotatably sleeves the main poking shaft 761, the right synchronous belt wheel 743 and the right transmission gear 748 are coaxial and are fixedly connected on the right synchronous belt wheel 743, an inward internal space is saved and the manufacture cost is saved.

A specific working process of the central clamping device is: firstly, the rotary gear disk 72 is located in an initial position where the reset pushing rod 755 and the reset oil cylinder 756 are matched. Then the reset oil cylinder 756 is started, such that a push rod thereof pushes the reset pushing rod 755, the reset pushing rod 755 is stressed to upward push the left pushing block 7512 and the right pushing block 7522, and the clamping mechanism 75 is opened. After the tubular product is placed therein, the reset oil cylinder 756 is closed, the reset pushing rod 755 is retreated, the left clamping block 751 and the right clamping block 752 respectively rotate in an opposite direction under the action of a pull force of the left tension spring 753 and the right tension spring 754 till the left chuck 7511 and the right chuck 7521 clamp the tubular product, and the charging is ended.

In the bending process of the tubular product, the rotation of the rotary gear disk 72 is controlled by controlling the power device 73. A specific transmission process is: the servomotor 731 drives the right angle speed reducer 732 to drive the main synchronous belt wheel 741 to rotate, the main synchronous belt wheel 741 drives the left synchronous belt wheel 742 and the right synchronous belt wheel 743 to rotate through the synchronous belt 746, while the left transmission gear 747 and the left synchronous belt wheel 742 rotate synchronously, the right transmission gear 748 and the right synchronous belt wheel 743 rotate synchronously, the left transmission gear 747 drives the left transition gear 744 to rotate, the right transmission gear 748 drives the right transition gear 745 to rotate, and the left transition gear 744 and the right transition gear 745 drive the rotary gear disk 72 to rotate together such that the tubular product rotates to a required angle.

After the tubular product bending machine bends the tubular product, under the drive of the power device 73, the rotary gear disk 72 rotates to a position where the reset pushing rod 755 and the poking oil cylinder 78 are matched, then the poking oil cylinder 78 is started to push the reset pushing rod 755 out to open the clamping mechanism 75, afterwards, the poking cylinder 767 drives the rack 768 to move, the rack 768 transmits power to the poking gear shaft 763 meshed with the rack, the third poking gear 766 disposed on the poking gear shaft 763 drives the slave poking gear 765, the slave poking gear 765 drives the main poking gear 764, the main poking gear 764 drives the main poking shaft 761 to rotate to drive the poking arms 77 on two ends of the main poking shaft 761 to rotate, and the poking arms 77 rotate to finally push the tubular product to be separated from the clamping mechanism 75 and the rotary gear disk 72. Then the poking oil cylinder 78 is closed, such that the clamping mechanism 75 restores to be clamped, the power device 73 is started, and the rotary gear disk 72 is driven to rotate to the initial position, and the unloading is finished.

A wire trimming process is described briefly, specifically, the four feeding wheels 22 in the feeding straightening device 2 are controlled by the a wire trimming control system to be meshed with the tubular product to be conveyed forward, the treading rod 111 in the tubular product pulling unwinding mechanism 1 drives the revolution bottom plate 18 to rotate for certain angle $\alpha$, the angle measuring sensor 112 sends a signal to the wire trimming control system, the wire trimming control system compares it with a set angle $\beta$, if $\beta$ is larger than $\alpha$, then the angle measuring sensor 112 detects again, and if $\beta$ is smaller than $\alpha$, then the wire trimming control system sends a signal to the motor 12 to send a signal so as to drive the material disk 14 to feed the materials forwards. The feeding wheels 22 of the feeding straightening device 2 are meshed with the tubular product to convey it to the straightening component 231, the straightening power system 232 drives the straightening component 231 in the straightening mechanism 230 to rotate, and the five pairs of straightening modules in the straightening component 231 rotate to straighten the tubular product.

When conveyed, the tubular product straightened by the straightening component 231 penetrates through the length fixed mechanism 24 and the cutting-off mechanism 3 in sequence and moves to a position above the material holding arms of the material loading mechanism. When the tubular product is conveyed out, the measuring wheels 241 in the length fixing mechanism 24 are driven to rotate, the revolution encoder 242 connected to the measuring wheels 241 monitors a tubular product passing length L1 converted from a rotary angle of the measuring wheels 241 in real time and sends a signal to the wire trimming control system, the wire trimming control system compares the measured tubular product length L1 with a set value L, and till L1 equals to L, the wire trimming control system sends the signal to the feeding wheels 22 of the feeding straightening device 2 to stop rotation, at this point, the treading rod 111 rotates for certain angle, and when an included angle $\alpha$ the angle measuring sensor 112 is smaller than a set value $\alpha$ in the wire trimming control system, the wire trimming control system sends a signal to the motor 12 in the unwinding mechanism 1 to control the material disc to stop rotation and feeding. At this point, if the bending and molding device 4 has been in an idle state, then the wire trimming control system controls the material holding arms 53 in the material loading mechanism 5 to clamp the tubular product, and then a shearing oil cylinder 34 in the cutting-off mechanism 3 extends to cut off the tubular product.

Then, the transmission shaft 52 drives the material holding arms 53 to overturn by a certain angle to feed the tubular product to the central clamping mechanism 45, and the clamping mechanism 75 in the rotary gear disk 72 clamps the tubular product. Then, the material loading mechanism 5 is reset to one side of the cutting-off mechanism to wait for the next charging period, at this point, the unwinding mechanism 1 and the feeding straightening device 2 enter the next feeding straightening period, and the bending and molding device 4 bends and molds the tubular product.

After the tubular product bending machine bends the tubular product, under driving of the power device, the rotary gear disk 72 of the central clamping device 45 rotates to a position where the reset pushing rod 755 and the poking oil cylinder 78 are matched, then the poking oil cylinder 78 is started to open the clamping mechanism 75, then the poking cylinder 767 drives the poking arms 77 disposed on two ends of the poking cylinder to rotate, the poking arms 77 rotate and finally push the tubular product to be separated from the clamping mechanism 75 and the rotary gear disk 72, then the poking oil cylinder 78 is closed, such that the clamping mechanism restores the clamping, the power device 73 is started, the rotary gear disk 72 is driven to rotate to the initial position, and unloading is finished.

The above embodiments merely exemplarily illustrate the principle and effects of the present invention and are merely partially applied embodiments instead of limiting the present invention; it should be pointed out that those skilled in the art can make some transformations and improvements without departing from creative thought of the present invention, and those transformations and improvements all belong to a protective scope of the present invention.

What is claimed is:

1. A bending and molding production line, comprising:

an unwinding mechanism, a feeding and straightening device, a cutting-off mechanism, a bending and molding device, a bending and molding mechanism, and a material loading mechanism for transferring a tubular product to the bending and molding device from the cutting-off mechanism, wherein the bending and molding device comprises a base, the base is provided with a transverse sliding rail, and two transverse sliding bases disposed on the transverse sliding rail in a sliding manner, the base is provided with a transverse driving device driving the transverse sliding bases, the base is provided with a central clamping device which can clamp the tubular product and can rotate around a central axis of the tubular product between the two transverse sliding bases, each of the transverse sliding bases are provided with a longitudinal sliding rail, each of the longitudinal sliding rails is provided with a longitudinal sliding base, of two longitudinal sliding bases, which include a longitudinal sliding base at a left side and a longitudinal sliding base at a right side, each of the transverse sliding bases are provided with a longitudinal sliding device driving the longitudinal sliding base to slide, the longitudinal sliding base is provided with the bending and molding device, one side, which faces to the central clamping device, of the transverse sliding base at the left side is provided with a left clamping device capable of movably extending to clamp the tubular product, one side, which faces to the central clamping device, of the transverse sliding base at the right side is provided with a right clamping device capable of movably extending to clamp the tubular product, the bending and molding mechanism comprises a hollow mounting base rotatably disposed on each longitudinal sliding base, a hollow shaft is rotatably disposed in the hollow mounting base in a penetrating manner, a mandrel is rotatably disposed in the hollow shaft in a penetrating manner, one end of the hollow shaft and one end of the mandrel extend out of each longitudinal sliding base, the hollow shaft is provided with a moving bending head at the end, an end part of the moving bending head is cylindrical and its periphery is provided with a circle of groove matched with the tubular product, the mandrel is detachably provided with a bending die at the end, the bending die is provided with four cylindrical fixed bending modules arranged in two rows, connecting lines between the fixed bending modules are in a rectangle, an interval between the two rows of fixed bending modules is matched with a diameter of the tubular product to be bent, another end opposite to the end of the mandrel is connected to a fixed die motor disposed on each longitudinal siding base, a driven synchronous belt wheel sleeves a periphery of the other end of the hollow shaft, each longitudinal siding base is provided with a moving die motor, an output shaft of the moving die motor is provided with a driving synchronous belt wheel matched with the driven synchronous belt wheel, and a synchronous belt sleeves the driven synchronous belt wheel and the driving synchronous belt wheel, wherein the central clamping device comprises a box body, a rotary gear disk rotatably disposed on the box body, a power device disposed on the box body, a transmission mechanism connected to the rotary gear disk and the power device, and a clamping mechanism disposed on the rotary gear disk for clamping the tubular product, wherein the rotary gear disk is provided with a containing notch penetrating through the center of the rotary gear disk; the clamping mechanism comprises a left clamping block and a right clamping block; the left clamping block and the right clamping block are symmetric and bottom ends are hinged to a disk surface of the rotary gear disk; upper parts at opposite sides of the left clamping block and the right clamping block are provided with a left chuck and a right chuck respectively; an axis of the tubular product clamped by the left chuck and the right chuck is coincided with a central axis of the rotary gear disk; a lower part of the left clamping block located on the left chuck is provided with a left pushing block, a lower part of the right clamping block located on the right chuck is provided with a right pushing block, the upper parts of one sides, back onto each other, of the left clamping block and the right clamping block are connected to the rotary gear disk by a left tension spring and a right tension spring respectively, and a pull force of the left tension spring and the right tension spring drives the left chuck and the right chuck to abut against each other; a lower part of the disk surface of the rotary gear disk located on the left pushing block and the right pushing block is provided with a reset pushing rod, the box body is provided with a reset oil cylinder driving the reset pushing rod to move, the reset pushing rod pushes the left pushier block and the right pushing block when pushed upward, such that the left clamping block and the right clamping block rotate to separate the left chuck from the right chuck; the transmission mechanism comprises a left transition gear and a right transition gear disposed on two sides of the reset oil cylinder in the box body respectively and meshed with the rotary gear disk, a left transmission gear meshed with the left transition gear is disposed in the box body and a right transmission gear meshed with the right transition gear is disposed in the box body, a left synchronous belt coaxial with the left transmission gear and capable of synchronous rotating with the left transmission gear and a right synchronous belt coaxial with the right transmission gear and capable of synchronous rotating with the right transmission gear are further disposed in the box body, an output shaft of the power device is fixedly connected to a main synchronous belt wheel, and a main synchronous belt sleeves the main synchronous belt wheel, the left synchronous belt wheel and the right synchronous belt wheel.

2. The bending and molding production line according to claim 1, wherein the left clamping device comprises a left base disposed on the longitudinal sliding base at the left side, an angle exists between an upper surface of the longitudinal sliding base and the left base, the upper surface of the left base is provided with a left sliding rail, the left sliding rail is provided with a left sliding base, the left sliding base is provided with a left mounting base, the left mounting base is provided with a clamping component driven by a clamping cylinder to open or clamp, and the left base is provided with a sliding cylinder driving the left sliding base to drive the clamping component to approach to the tubular product; the right clamping device comprises a right base disposed on the longitudinal sliding base at the right side, an angle exists between the upper surface of the longitudinal sliding base and the right base, the right base is provided with a right sliding rail, the right sliding rail is provided with a right sliding base, the right sliding base is provided with a right mounting base, the right mounting base is provided with a clamping component driven by a clamping cylinder to open or clamp, and the right base is provided with a sliding cylinder driving the right sliding base to drive the clamping component to approach to the tubular product; and the bending and molding mechanism is disposed in a position of each of the longitudinal sliding bases.

3. The bending and molding production line according to claim 2, wherein the unwinding mechanism comprises a box type base, a motor and a speed reducer connected to the motor are disposed in the box type base, a material disc is rotatably disposed on the base, the speed reducer drives the material disc to rotate, the material disc is provided with a central rod coaxial with an output shaft of the speed reducer, the material disc is provided with at least three blocking rods, the blocking rods are uniformly distributed around the central rod, the base is also fixedly connected to a bottom plate, the bottom plate is rotatably provided with a revolution bottom plate, the bottom plate and the revolution bottom plate are rotatably connected by a rotary shaft, the rotary shaft is parallel with the central rod, a reset spring is further disposed between the bottom plate and the revolution bottom plate, one end of the reset spring is fixedly connected on the bottom plate, the other end of the reset spring is fixedly connected to the revolution bottom plate, an upper surface of the revolution bottom plate is connected to a treading rod guiding a moving trend of the tubular product, the treading rod and the central rod are matched, a top end of the treading rod is provided with a limiting device preventing the tubular product from being separated from the treading rod, the revolution bottom plate is further provided with an angle measuring sensor for measuring a swing angle of the treading rod, the base is provided with a controller electrically connected to the angle measurement sensor.

4. The bending and molding production line according to claim 2, wherein the feeding straightening device comprises a rack, the rack is provided with two pairs of feeding wheels, a straightening mechanism and a length fixing mechanism along a straight line in sequence, a wire passing base is disposed at a front part of the feeding wheels, between the two pairs of the feeding wheels and the straightening mechanism on the rack respectively, the straightening mechanism comprises a hollow straightening component rotatably disposed on the rack and a straightening power system driving the hollow straightening component to rotate, the hollow straightening component comprises a hollow left end shaft, at least three straightening dies and a hollow right end shaft, the hollow left end shaft and the hollow right end shaft are rotatably disposed on the rack respectively, a connecting block with a material passing hole in the middle is disposed among the adjacent straightening dies, the positions of the straightening dies meet a condition that the central lines of all straightening dies are in staggered arrangement relative to the axis of the hollow left end shaft, the straightening die comprises two straightening modules provided with semicircular slots matched with the diameter of the tubular product to be straightened, connecting surfaces of the hollow left end shaft, the connecting blocks and the hollow right end shaft matched with the straightening dies are provided a mounting groove matched with the shape of the straightening die and an arc slot located for compressing compression bolts of the straightening dies and internally provided with a plurality of threaded sections respectively, the length fixing mechanism comprises a pair of measuring wheels driven by the tubular product to rotate and placed on the rack, and one of the measuring wheels is connected to a revolution encoder.

5. The bending and molding production line according to claim 2, wherein the cutting-off mechanism comprises a mounting base, the mounting base is provided with two upright plates vertical to each other, one upright plate is provided with a fixed shearing head, the other upright plate parallel with a feeding direction is provided with a shearing oil cylinder and an end part of a piston rod of the shearing oil cylinder is provided with a moving shearing head matched with the fixed shearing head.

6. The bending and molding production line according to claim 2, wherein the material loading mechanism comprises two end part mounting frames disposed on two ends of the base of the bending and molding device respectively, the end part mounting frames are rotatably provided with a transmission shaft and a charging power device driving the transmission shaft, the transmission shaft is provided with at least two material holding arms in parallel, an end part of each material holding arm is provided with a pneumatic clamping component which is controlled by a cylinder to open or clamp, and the positions of the material holding arms are matched with the positions where the cutting-off mechanism and the central clamping mechanism charge the tubular product.

7. The bending and molding production line according to claim 1, wherein the box body is further provided with a poking mechanism for unloading, the poking mechanism comprises a main poking shaft vertical to the rotary gear disk and rotatably connected to the box body, two ends of the main poking shaft extend out of the box body and are connected to a poking arm which pokes the tubular product out of a containing notch respectively when rotating, a main poking gear is fixedly disposed on the main poking shaft in the box body, a slave poking gear meshed with the main poking gear is rotatably disposed in the box body, a poking gear shaft is rotatably disposed in the box body, a third poking gear meshed with the slave poking gear is fixedly disposed on the poking gear shaft, a poking cylinder is disposed under the third poking gear in the box body, a rack is disposed at an end part of a piston rod of the poking cylinder, the rack is meshed with a poking driving gear fixedly sleeving the poking gear shaft, and an upper part of the reset oil cylinder in the box body is further provided with a poking oil cylinder capable of driving the reset pushing rod to move.

8. The bending and molding production line according to claim 1, further comprises a longitudinal driving device comprising a longitudinal servomotor disposed on each of the transverse sliding bases, each of the longitudinal sliding bases is provided with a longitudinal lead screw, and the longitudinal servomotor is connected to an end part of the longitudinal lead screw by a coupler.

9. The bending and molding production line according to claim 1, wherein the transverse driving device comprises a rack disposed on the base, each of the transverse sliding bases is provided with a transverse driving motor, and an output shaft of the transverse driving motor downwards penetrates out of the transverse sliding base and is connected to a synchronous belt wheel matched with the rack.

10. The bending and molding production line according to claim 1, wherein the unwinding mechanism comprises a box type base, a motor and a speed reducer connected to the motor are disposed in the box type base, a material disc is rotatably disposed on the base, the speed reducer drives the material disc to rotate, the material disc is provided with a central rod coaxial with an output shaft of the speed reducer, the material disc is provided with at least three blocking rods, the blocking rods are uniformly distributed around the central rod, the base is also fixedly connected to a bottom plate, the bottom plate is rotatably provided with a revolution bottom plate, the bottom plate and the revolution bottom plate are rotatably connected by a rotary shaft, the rotary shaft is parallel with the central rod, a reset spring is further disposed between the bottom plate and the revolution bottom plate, one end of the reset spring is fixedly connected on the bottom plate, the other end of the reset spring is fixedly connected to the revolution bottom plate, an upper surface of the revolution bottom plate is connected to a treading rod guiding a moving trend of the tubular product, the treading rod and the central rod are matched, a top end of the treading rod is provided with a limiting device preventing the tubular product from being separated from the treading rod, the revolution bottom plate is further provided with an angle measuring sensor for measuring a swing angle of the treading rod, the base is provided with a controller electrically connected to the angle measurement sensor.

11. The bending and molding production line according to claim 1, wherein the feeding straightening device comprises a rack, the rack is provided with two pairs of feeding wheels, a straightening mechanism and a length fixing mechanism along a straight line in sequence, a wire passing base is disposed at a front part of the feeding wheels, between the two pairs of the feeding wheels and the straightening mechanism on the rack respectively, the straightening mechanism comprises a hollow straightening component rotatably disposed on the rack and a straightening power system driving the hollow straightening component to rotate, the hollow straightening component comprises a hollow left end shaft, at least three straightening dies and a hollow right end shaft, the hollow left end shaft and the hollow right end shaft are rotatably disposed on the rack respectively, a connecting block with a material passing hole in the middle is disposed among the adjacent straightening dies, the positions of the straightening dies meet a condition that the central lines of all straightening dies are in staggered arrangement relative to the axis of the hollow left end shaft, the straightening die comprises two straightening modules provided with semicircular slots matched with the diameter of the tubular product to be straightened, connecting surfaces of the hollow left end shaft, the connecting blocks and the hollow right end shaft matched with the straightening dies are provided a mounting groove matched with the shape of the straightening die and an arc slot located for compressing compression bolts of the straightening dies and internally provided with a plurality of threaded sections respectively, the length fixing mechanism comprises a pair of measuring wheels driven by the tubular product to rotate and placed on the rack, and one of the measuring wheels is connected to a revolution encoder.

12. The bending and molding production line according to claim 1, wherein the cutting-off mechanism comprises a mounting base, the mounting base is provided with two upright plates vertical to each other, one upright plate is provided with a fixed shearing head, the other upright plate parallel with a feeding direction is provided with a shearing oil cylinder and an end part of a piston rod of the shearing oil cylinder is provided with a moving shearing head matched with the fixed shearing head.

13. The bending and molding production line according to claim 1, wherein the material loading mechanism comprises two end part mounting frames disposed on two ends of the base of the bending and molding device respectively, the end part mounting frames are rotatably provided with a transmission shaft and a charging power device driving the transmission shaft, the transmission shaft is provided with at least two material holding arms in parallel, an end part of each material holding arm is provided with a pneumatic clamping component which is controlled by a cylinder to open or clamp, and the positions of the material holding arms are matched with the positions where the cutting-off mechanism and the central clamping mechanism charge the tubular product.

* * * * *